US008163335B2

(12) United States Patent
Ito et al.

(10) Patent No.: US 8,163,335 B2
(45) Date of Patent: Apr. 24, 2012

(54) PARTICLE CLUSTER, COMPOSITE STRUCTURE FORMATION METHOD, AND FORMATION SYSTEM

(75) Inventors: Tomokazu Ito, Fukuoka-ken (JP); Hironori Hatono, Fukuoka-ken (JP)

(73) Assignee: Toto Ltd., Fukuoka (JP)

( * ) Notice: Subject to any disclaimer, the term of this patent is extended or adjusted under 35 U.S.C. 154(b) by 296 days.

(21) Appl. No.: 12/454,854

(22) Filed: May 22, 2009

(65) Prior Publication Data

US 2009/0311422 A1 Dec. 17, 2009

Related U.S. Application Data

(60) Provisional application No. 61/055,468, filed on May 23, 2008.

(51) Int. Cl.
*B05D 1/12* (2006.01)

(52) U.S. Cl. ..... 427/201; 427/421.1; 427/427

(58) Field of Classification Search ..... 427/201, 427/427, 421.1
See application file for complete search history.

(56) References Cited

U.S. PATENT DOCUMENTS

2006/0099336 A1* 5/2006 Hatono et al. ..... 427/180
2007/0231480 A1 10/2007 Yasui

FOREIGN PATENT DOCUMENTS

| | | |
|---|---|---|
| JP | 3348154 | 9/2002 |
| JP | 2006-200013 | 8/2006 |
| JP | 2006-233334 | 9/2006 |
| JP | 2007-291502 A | 11/2007 |
| WO | WO 01/27348 A1 | 4/2001 |

* cited by examiner

*Primary Examiner* — Frederick Parker
(74) *Attorney, Agent, or Firm* — Carrier Blackman & Associates, P.C.; Joseph P. Carrier; William D. Blackman

(57) ABSTRACT

A particle cluster for an aerosol deposition method, the particle cluster includes: an assembly packed with a plurality of fine particles including brittle material fine particles, the particle clusters having a spatula angle of 46.2° or less.

5 Claims, 25 Drawing Sheets

PARTICLE CLUSTER, COMPOSITE STRUCTURE FORMATION METHOD, AND FORMATION SYSTEM

CROSS-REFERENCE TO RELATED APPLICATIONS

This application is based upon and claims the benefit of priority from the prior American Patent Application No. 61/055,468, filed on May 23, 2008; the entire contents of which are incorporated herein by reference.

BACKGROUND OF THE INVENTION

1. Field of the Invention

This invention relates to a particle cluster, a composite structure formation method, and a formation system, and more particularly to a particle cluster, a composite structure formation method, and a formation system for aerosol deposition method by which an aerosol with fine particles of a brittle material dispersed in a gas is sprayed onto a substrate to form a structure made of the fine particles on the substrate.

2. Background Art

The "aerosol deposition method" is one of the methods for forming a structure made of a brittle material on the surface of a substrate (e.g., Patent Documents 1 to 3). In this method, an aerosol in which fine particles including a brittle material are dispersed in a gas is sprayed from a discharge port toward the substrate to collide the fine particles with the metal, glass, ceramic, or plastic substrate, deforming or crushing the brittle material fine particles by the impact of this collision to join them together, so that a film-like structure made of the fine particles is directly formed on the substrate. This method can form a film-like structure at normal temperature without requiring any specific heating means and the like, and can provide a film-like structure having a mechanical strength which is at least comparable to that of a sintered body. Furthermore, the condition for colliding the fine particles as well as the shape, composition and the like of the fine particles can be controlled to diversely vary the density, mechanical strength, electrical characteristics and the like of the structure.

To form a large-area film-like structure by this aerosol deposition method, fine particles need to be continuously supplied for a prescribed period of time. In particular, in the case where a high film thickness accuracy is required, it is desired that the supply quantity of fine particles be constantly stable.

However, as disclosed in Patent Document 1, if aerosolation is allowed to occur in a storage mechanism storing fine particles of a raw material, the capacity of the storage mechanism needs to be far larger than the volume of fine particles to secure the capacity for aerosolation, which may require a large-scale apparatus. Furthermore, when a large quantity of fine particles are stored, the state of the fine particles may change over time, leaving a problem with stable supply of the aerosol.

In this context, as disclosed in Patent Documents 2 and 3, a technique is proposed in which the storage mechanism for storing fine particles is separated from the aerosolation mechanism for mixing the fine particles with a gas to produce an aerosol, and the fine particles are transported from the storage mechanism to the aerosolation mechanism by required amount.

However, in the case where submicron or smaller fine particles are used as primary particles, because of high viscosity and adhesiveness, the problems of adhesion, stacking and the like to the wall surface are likely to occur inside the storage mechanism and in the process of transport from the storage mechanism to the aerosolation mechanism, which may make it difficult to transport reliably. For instance, fine particles become likely to aggregate due to agitation and migration inside the storage mechanism and change their fluidity. Eventually, stacking occurs inside the storage mechanism and prevents migration of powder to the aerosolation mechanism, and hence the quantitativeness of the supply quantity is lost. Furthermore, adhesion occurring inside the storage mechanism may also yield adverse effects, such as failing to achieve powder usage as planned.

Furthermore, the fine particle, or the group of fine particles split in a prescribed size and shape, may be nonuniform in shape and density when carried out of the storage mechanism. In this case, even using an aerosolation mechanism having a prescribed disaggregation capability, it may be difficult to generate an aerosol with a constantly stable fine particle concentration. Furthermore, also in the case where the group of fine particles split in a prescribed size and shape changes in shape or density during the transport process, it may be difficult to accurately control the fine particle concentration in the aerosol.

Patent Document 1: Japanese Patent No. 3348154
Patent Document 2: JP-A-2006-200013
Patent Document 3: JP-A-2006-233334

SUMMARY OF THE INVENTION

According to an aspect of the invention, there is provided a particle cluster for aerosol deposition method, the particle cluster including: an assembly packed with a plurality of fine particles including brittle material fine particles, the particle clusters having a spatula angle of 46.2° or less.

According to another aspect of the invention, there is provided a particle cluster for aerosol deposition method, the particle cluster including: a plurality of fine particles, the fine particle having a mean particle diameter of 0.1 micrometers or more and 10 micrometers or less, the particle cluster having a mean particle diameter of 10 micrometers or more and 500 micrometers or less, and the particle cluster having a spatula angle of 46.2° or less.

According to another aspect of the invention, there is provided a composite structure formation method including: transporting particle clusters according to any one of claims 1 to 4 stored in a storage mechanism from the storage mechanism to an aerosolation mechanism in combination with a gas supplied from a gas supply mechanism; disaggregating the transported particle clusters to form an aerosol; and spraying the aerosol toward a substrate to form a composite structure of the substrate and a structure made of a constituent material of the particle clusters.

According to another aspect of the invention, there is provided a composite structure formation method including: transporting particle clusters according to any one of claims 1 to 4 stored in a storage mechanism from the storage mechanism to an aerosolation mechanism; disaggregating the transported particle clusters in combination with a gas supplied from a gas supply mechanism to form an aerosol; and spraying the aerosol toward a substrate to form a composite structure of the substrate and a structure made of a constituent material of the particle clusters.

According to another aspect of the invention, there is provided a composite structure formation system in which an aerosol with fine particles dispersed in a gas is collided with a substrate to form a composite structure having the substrate and a structure made of the fine particles, the composite structure formation system including: a storage mechanism configured to store particle clusters according to any one of claims 1 to 4; a supply mechanism configured to transport the particle clusters from the storage mechanism; a gas supply mechanism configured to supply a gas toward the transported particle clusters; an aerosolation mechanism configured to apply impact to the particle clusters mixed with the gas, thereby disaggregating them into a plurality of fine particles to form an aerosol; and a discharge port configured to spray the aerosol onto a substrate.

DETAILED DESCRIPTION OF THE INVENTION

Figure 1:
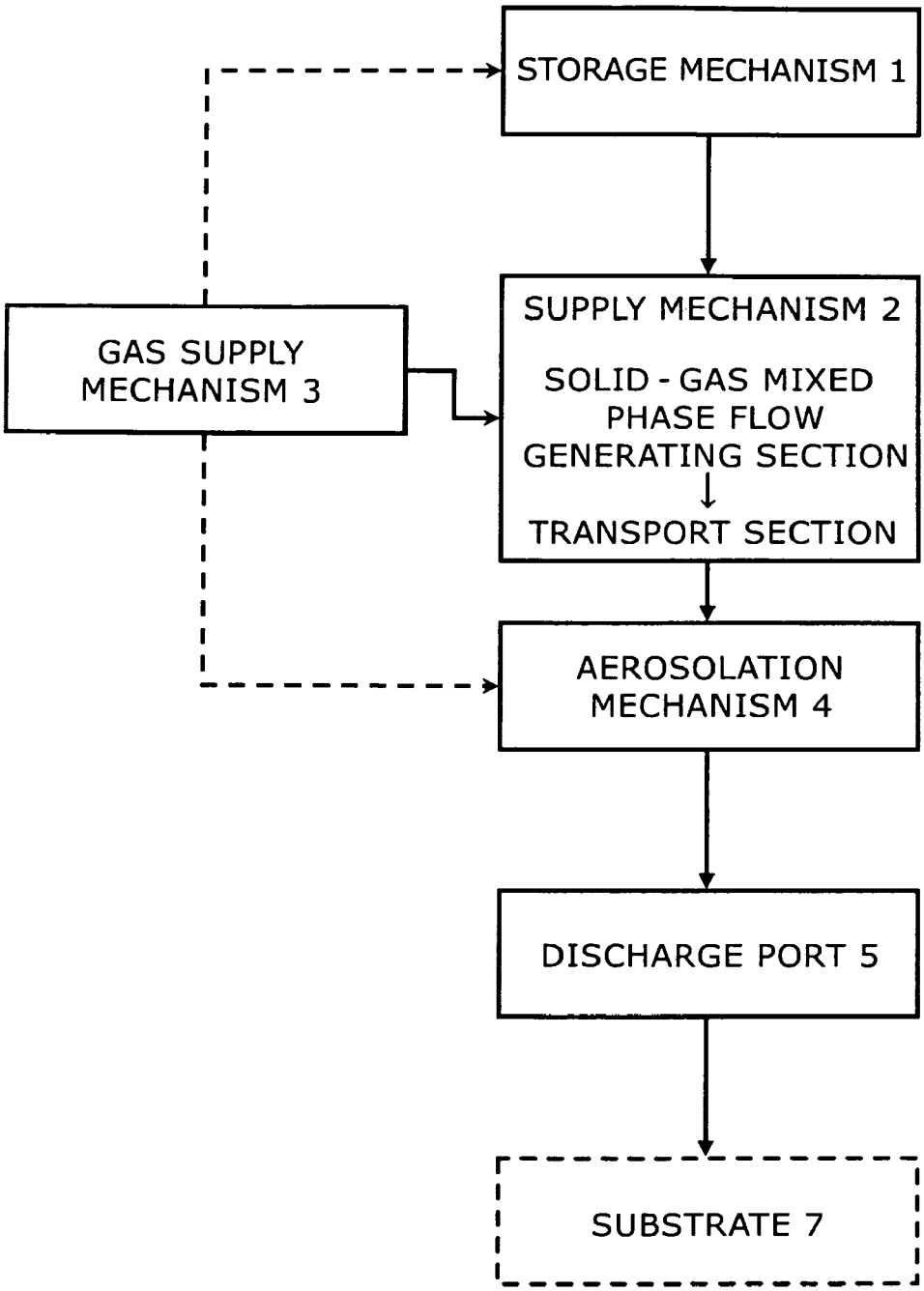
FIG. 1 is a block diagram for illustrating the basic configuration of a composite structure formation system according to an embodiment of the invention.

Before the description of an embodiment of the invention, terms used herein are first described.

A "fine particle" as used herein refers to, in the case of a dense particle, a particle having a mean particle diameter of 0.1 micrometers or more and 10 micrometers or less as determined by scanning electron microscopy and the like. A "primary particle" refers to the minimum unit (single particle) of the fine particle. In determining the mean particle diameter by scanning electron microscopy, 100 fine particles are arbitrarily selected in the observed image, and by using the mean value of the long-axis and short-axis length thereof, the mean particle diameter can be calculated from the mean values of all the fine particles observed. Brittle material particles in the aforementioned fine particle are the main constituent of the structure formation in the aerosol deposition method, where the mean particle diameter of the primary particle is 0.01 micrometers or more and 10 micrometers or less, and more preferably 0.1 micrometers or more and 5 micrometers or less.

A "particle cluster" refers to an assembly packed with a plurality of fine particles including brittle material fine particles with its shape and/or density intentionally controlled. Here, the mean particle diameter of the particle cluster is preferably 10 micrometers or more and 500 micrometers or less. The standard deviation of the particle diameter of the particle cluster divided by the mean particle diameter of the particle cluster is preferably 33% or less.

In the particle cluster, preferably, most of the fine particles are in the state of being separated from each other, that is, being in light contact with each other, or being compacted and lightly coupled to each other by static electricity, van der Waals force, moisture, bridging through a trace quantity of binder components, and the like. By intentionally packing fine particles, at least one of the coupling strength and shape thereof is controlled. Here, preferably, fine particles contained therein are not packed by chemical coupling to a size which is significantly larger than the diameter of the primary particle. Fine particles can be illustratively packed by using a spray dryer method, pan granulator, pot granulator and the like. In the packing process, a binder may be added, or water and the like may be added. The spray dryer method, pan granulator, pot granulator and the like can be based on known techniques, and hence the description thereof is omitted.

The mean particle diameter and the standard deviation of the particle cluster can be calculated illustratively by measuring the diameter of 100 randomly selected particle clusters using an optical microscope. Here, if the particle cluster is not shaped like a true sphere, the mean value of the long-axis and short-axis length of the projected image of the particle can be used for calculation.

A "solid-gas mixed phase flow" refers to the state where the aforementioned particle clusters controlled to a prescribed size are migrating on a gas flow.

An "aggregate" refers to a collection of fine particles which is not a collection of fine particles intentionally provided with a prescribed size and/or shape, but is spontaneously formed from the fine particles coupled to each other, where its size, shape, and coupling strength are also not controlled.

An "aerosol" refers to a state in which the aforementioned fine particles are dispersed in a gas such as helium gas, argon gas and other inert gas, nitrogen gas, oxygen gas, dry air, hydrogen gas, organic gas, fluorine gas, and a mixed gas including them, where the fine particles are dispersed substantially separately, although the aerosol may partly include aggregates. The gas pressure and temperature of the aerosol are arbitrary. However, the concentration of fine particles in the gas at the point of being sprayed from a discharge port, in terms of the value at a gas pressure of 1 atmosphere and a temperature of 20 degrees Celsius, is preferably in the range from 0.0003 to 10 mL/L for the purpose of forming a film-like structure.

"Stacking" refers to prevention of particle migration in a container or a channel traversed by particles due to adhesion of particles or aggregation of the particles themselves, or to the state in which it occurs. Stacking is likely to occur at a location where the cross-sectional shape of the channel traversed by particles is downsized, such as the outlet of the storage mechanism, the inlet of the supply mechanism, and the transport channel, described later.

Next, an embodiment of the invention is described with reference to the drawings.

FIG. 1 is a block diagram for illustrating the basic configuration of a composite structure formation system according to the embodiment of the invention. More specifically, this figure is a block diagram for illustrating the configuration of an aerosol deposition apparatus.

The aerosol deposition apparatus according to this embodiment includes a storage mechanism 1, a supply mechanism 2, a gas supply mechanism 3, an aerosolation mechanism 4, and a discharge port 5.

The supply mechanism 2 is provided at the subsequent stage of the storage mechanism 1. The aerosolation mechanism 4 is provided at the subsequent stage of the supply mechanism 2, and the discharge port 5 is provided at the subsequent stage of the aerosolation mechanism 4. The gas supply mechanism 3 is connected to the supply mechanism 2.

The storage mechanism 1 stores particle clusters which are formed in advance. The supply mechanism 2 supplies the subsequent aerosolation mechanism 4 with a prescribed quantity of the particle clusters stored in the storage mechanism 1 without impairing the shape and state of the particle cluster.

In combination with a gas supplied by the gas supply mechanism 3, the particle clusters supplied by the supply mechanism 2 form a solid-gas mixed phase flow (solid-gas mixed phase flow generating section), which is transported to the aerosolation mechanism 4 through a transport section (transport channel). The transported particle clusters are disaggregated in the aerosolation mechanism 4, and fine particles are dispersed in the gas to form an aerosol. The aerosol is sprayed from the discharge port 5 toward a substrate 7, and a film-like structure 6 (see FIG. 5) is formed on the substrate 7.

Here, instead of forming a solid-gas mixed phase flow, it is also possible to transport particle clusters from the supply mechanism 2 through the transport section (transport channel) to the aerosolation mechanism 4 and disaggregate the particle clusters in the aerosolation mechanism 4 using the transported particle clusters and a gas supplied from the gas supply mechanism 3 to form an aerosol in which fine particles are dispersed in the gas.

However, if the solid-gas mixed phase flow is formed, it serves not only to transport particle clusters, but also to accelerate the particle clusters toward the aerosolation mechanism 4. This causes physical disaggregation, which advantageously facilitates aerosolation.

The gas supply mechanism 3 may be connected to the storage mechanism 1 to reliably transport particle clusters to the aerosolation mechanism 4, or may be connected to the aerosolation mechanism 4 to adjust the fine particle concentration in the aerosol.

Here, the principle of the aerosol deposition method is described.

Fine particles used in the aerosol deposition method are composed primarily of a brittle material such as ceramics and semiconductors. Here, fine particles of a single material property can be used alone, or fine particles having different particle diameters can be mixed. Furthermore, it is also possible to use a mixture or composite of different kinds of brittle material fine particles. Furthermore, the brittle material fine particles can be mixed with fine particles of a metal material, organic material or the like, or the surface of the brittle material fine particle can be coated therewith. However, even in these cases, the film-like structure is composed primarily of a brittle material.

In the aerosol deposition method, colliding fine particles with a substrate at a velocity of 50 to 450 m/s is suitable to obtain a structure made of the brittle material fine particles in the fine particles.

The process of the aerosol deposition method is typically performed at normal temperature, and characterized, in one aspect, in that a film-like structure can be formed at a temperature sufficiently lower than the melting point of the fine particle material, that is, at several hundred degrees Celsius or less.

In the case where fine particles of a crystalline brittle material are used as a raw material, the film-like structure portion of the composite structure formed by the aerosol deposition method is composed of polycrystals in which the crystal particle size thereof is smaller than that of the raw material fine particle, and the crystal often lacks substantial crystalline orientation. Furthermore, no substantial grain boundary layer made of a glass layer exists at the interface between the brittle material crystals. Furthermore, the film-like structure portion often includes an "anchor layer" which bites into the surface of the substrate. Because of this anchor layer, the film-like structure formed is robustly adhered to the substrate with very high strength.

The film-like structure formed by the aerosol deposition method has sufficient strength, being clearly distinct from the so-called "green compact" in which fine particles are packed together by pressure and keep shape by physical adhesion.

Here, that incoming brittle material fine particles have deformed or fractured on the substrate in the aerosol deposition method can be verified by measuring the crystallite size of the brittle material fine particle used as a raw material and of the formed brittle material structure by X-ray diffractometry and the like.

The crystallite size of the film-like structure formed by the aerosol deposition method is smaller than the crystallite size of the raw material fine particle. Furthermore, a "new surface", where atoms originally located inside the fine particle and bonded to other atoms are exposed, is formed at the "shear surface" and "fracture surface" formed by fracture and deformation of the fine particle. It is considered that this new surface, having high surface energy and being active, joins with the surface of an adjacent brittle material fine particle, the new surface of an adjacent brittle material, or the surface of the substrate to form a film-like structure.

Furthermore, if a proper quantity of hydroxy groups exist at the surface of fine particles in the aerosol, it is considered that, at the time of collision of the fine particle, local shear stress and the like between fine particles or between the fine particle and the structure cause mechanochemical acid-base dehydration reaction, which joins them together. It is considered that continuous external application of mechanical impact force successively causes these phenomena, and repeated deformation, fracture and the like of fine particles develop and densify junctions, growing a film-like structure made of the brittle material.

As the findings obtained so far, with regard to the size of the fine particle, if the mean particle diameter is in the range of 0.1 micrometers or more and 10 micrometers or less, a film-like structure based on the aerosol deposition method is obtained. However, the mean particle diameter being 0.1 micrometers or less tends to result in the aforementioned "green compact". For 10 micrometers or more, the substrate tends to be blasted, and it is unsuitable as a particle diameter for use in the aerosol deposition method.

To disaggregate the particle cluster in the aerosolation mechanism, mechanical impact force produced by colliding the particle cluster with a wall, protrusion, rotating body or the like is useful. In particular, acceleration in the state of the solid-gas mixed phase flow in which particle clusters are mixed with a gas facilitates colliding the particle clusters having some mass with a wall or the like by inertial force. Here, the disaggregation energy depends on the mass and velocity of the particle cluster. To gain a velocity required for disaggregation, a pressure difference is required between before and after the aerosolation mechanism.

Here, to make more accurate the target quality of the film-like structure, such as its thickness and surface roughness, the mean particle diameter of the particle cluster is preferably controlled to 10 micrometers or more and 500 micrometers or less. In the case where the mean particle diameter of the fine particle is 0.1 micrometers or more and 10 micrometers or less, the size of the particle cluster being 10 micrometers or more is suitable because it facilitates forming a particle cluster nearer to a sphere. Furthermore, the size being 500 micrometers or less is suitable to disaggregate the particle cluster for aerosolation.

Furthermore, the standard deviation of the particle diameter of the particle cluster divided by the mean particle diameter of the particle cluster is preferably controlled to 33% or less. The particle diameter of the particle cluster in the aforementioned range allows the fine particle concentration in the aerosol to be stable.

On the basis of the inventor's findings, if the gas used is illustratively one of air, nitrogen, and oxygen, or a mixed gas composed primarily of the aforementioned gas, and the supply quantity of the gas for the minimum cross-sectional area of the transport channel has a volume flow rate of 0.05 L/(min·mm$^2$) or more and 50.0 L/(min·mm$^2$) or less in terms of the value at 1 atmosphere and 25° C., then the particle clusters in the solid-gas mixed phase flow can be efficiently accelerated, and aerosolation can be reliably and readily performed.

Here, in the aerosol deposition method, to produce a film-like structure being homogeneous over a large area and having a uniform thickness, the fine particle concentration in the sprayed aerosol needs to be constantly stable. That is, how to form an aerosol having a stable fine particle concentration is an important technical factor of this method in stabilizing the quality and grade of the film.

In this regard, in the technique as disclosed in Patent Document 1, the state of fine particles stored in the storage mechanism changes over time, for instance, which may make it difficult to generate an aerosol having a stable fine particle concentration.

Likewise, in the technique as disclosed in Patent Documents 2 and 3, in the case where submicron or smaller fine particles are used as primary particles, because of their high viscosity and adhesiveness, the problems of adhesion, stacking and the like to the wall surface are likely to occur inside the storage mechanism and in the process of transport from the storage mechanism to the aerosolation mechanism, which may make it difficult to generate an aerosol having a stable fine particle concentration.

Furthermore, also in the technique disclosed in Patent Document 3, which can form an aerosol having the most stable fine particle concentration, the fine particle or the group of fine particles split in a prescribed size and shape may be nonuniform in shape and density when supplied from the storage mechanism or in the process of transport. This may make it difficult, although instantaneously, to form an aerosol having a stable fine particle concentration.

In contrast, according to this embodiment, fine particles having high viscosity and adhesiveness are formed in advance into particle clusters in the state of a uniform shape or a uniform coupling strength, and the particle clusters in such a state are stored in the storage mechanism. Furthermore, the particle clusters are quantitatively supplied with their shape maintained. Hence, in the aerosolation mechanism provided at the subsequent stage, the fine particle concentration does not significantly vary also in a short period of time, and it is possible to form an aerosol having a fine particle concentration with accuracy and long-time stability. Consequently, the quantity of fine particles in the aerosol sprayed from the discharge port can be reliably controlled. Hence, the thickness and quality of the film-like structure formed on the substrate can also be reliably controlled.

Here, the shape of the particle cluster is important in stably and quantitatively supplying particle clusters inside the storage mechanism or in the process of transport.

As a result of studies, the inventors have found that if the particle clusters have a shape such that the spatula angle is 46.2° or less, it is possible to prevent adhesion, stacking and the like to the wall surface inside the storage mechanism and in the process of transport, and to form an aerosol having a fine particle concentration with long-time stability.

TABLE 1 illustrates the spatula angle of particle clusters studied by the inventors.

TABLE 1

Figure 2:
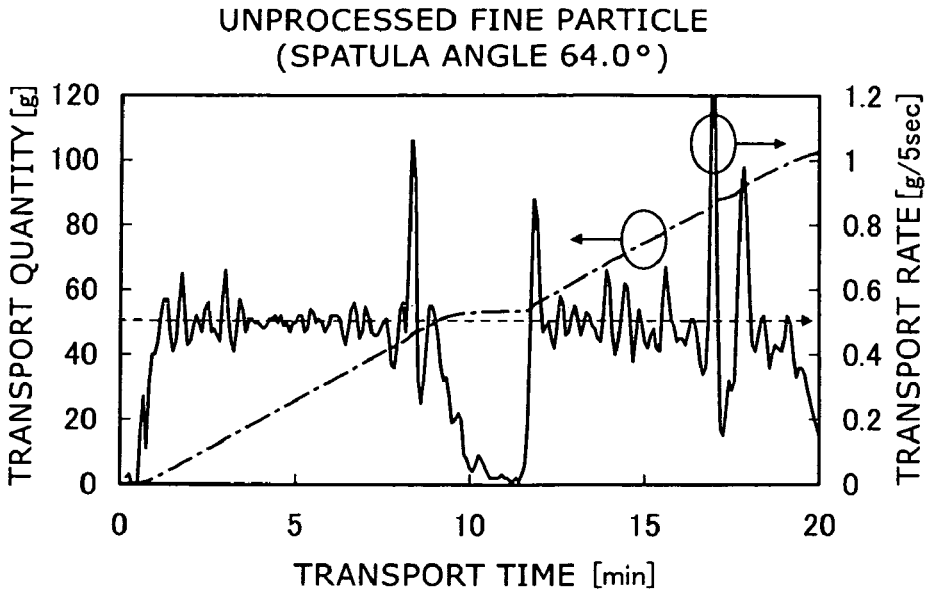
FIG. 2 is a graph for illustrating the evaluation result of transport stability.
Figure 3:
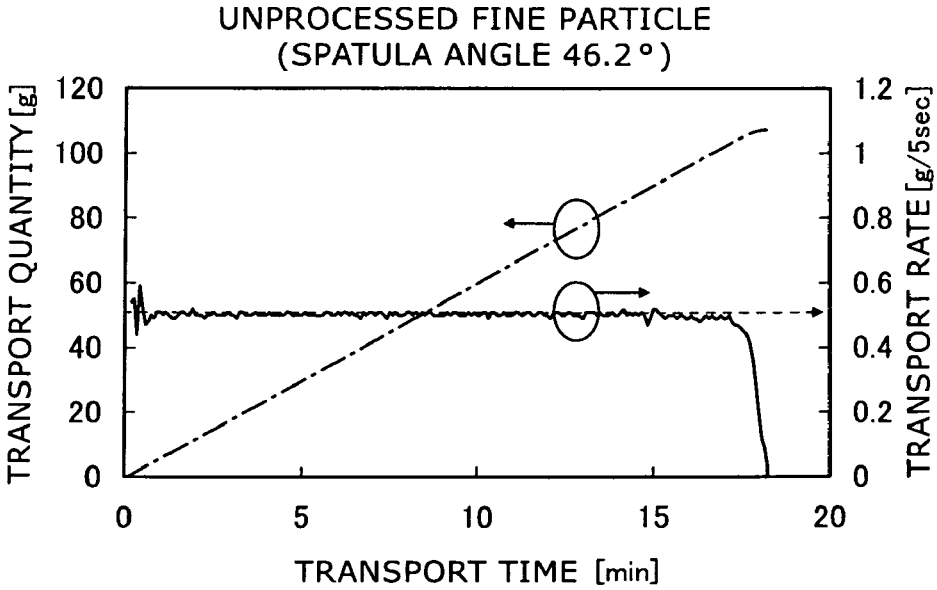
FIG. 3 is a graph for illustrating the evaluation result of transport stability.
Figure 4:
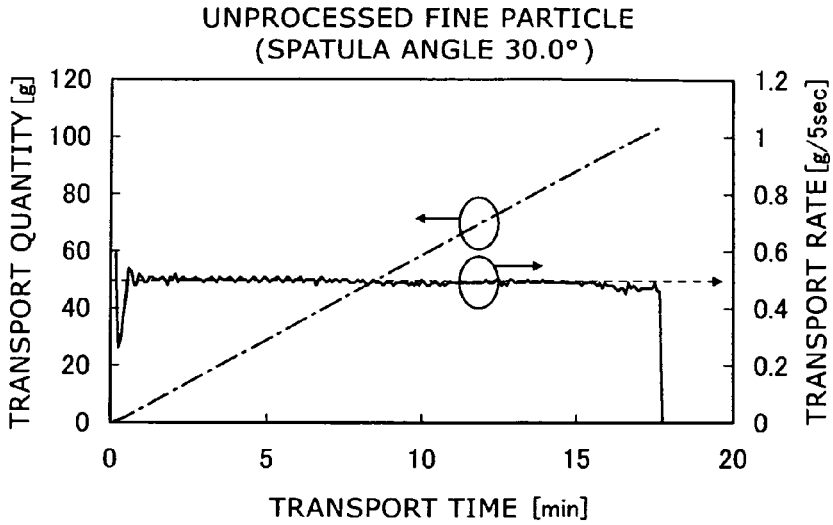
FIG. 4 is a graph for illustrating the evaluation result of transport stability.

| | Spatula angle (°) | Evaluation result of transport |
|---|---|---|
| Unprocessed fine particles | 64.0 | See FIG. 2 |
| Particle clusters C | 46.2 | See FIG. 3 |
| Particle clusters D | 30.0 | See FIG. 4 |

FIGS. 2 to 4 are graphs for illustrating the evaluation result of transport stability at respective spatula angles in the case of using a vibration-based supply apparatus.

In FIGS. 2 to 4, the solid line indicates transport rate (transport quantity per 5 sec (seconds)), the dashed line indicates the set value (target value) of the transport rate, and the dot-dashed line indicates cumulative transport quantity.

In this study, the fine particles forming the particle cluster was made of high-purity barium titanate having a mean particle diameter of 0.3 micrometers. The spatula angle was measured using Powder Tester PT-R manufactured by Hosokawa Micron Corporation. As a means for evaluating supply stability, a vibrating feeder was used to supply particle clusters. Here, evaluation of supply stability is not limited to the vibrating feeder, but it can be evaluated illustratively by dropping through an orifice or mesh.

As seen from FIG. 2, unprocessed fine particles (without adjustment of spatula angle) cannot be stably supplied. For instance, the transport quantity is not stabilized, and there is a period of time when no fine particle is supplied because of stacking in the container (around 10 min in FIG. 2).

On the other hand, as seen from FIGS. 3 and 4, if the spatula angle of the particle clusters is 46.2° or less, the transport quantity is stabilized, and stable supply on target can be achieved without stacking.

This tendency is not limited to the vibrating supply apparatus, but is also equivalent in supply apparatuses of the mesh type, roller type, belt conveyor type, and orifice type. Furthermore, not alone in the vibrating supply apparatus, an equivalent transport performance is reproduced also in supply apparatuses of the mesh type, roller type, belt conveyor type, and orifice type.

The spatula angle of the particle clusters can be adjusted when particle clusters are formed using known granulation methods such as rolling granulation, extruding granulation, and compressing granulation, and hence the description thereof is omitted.

Figure 5:
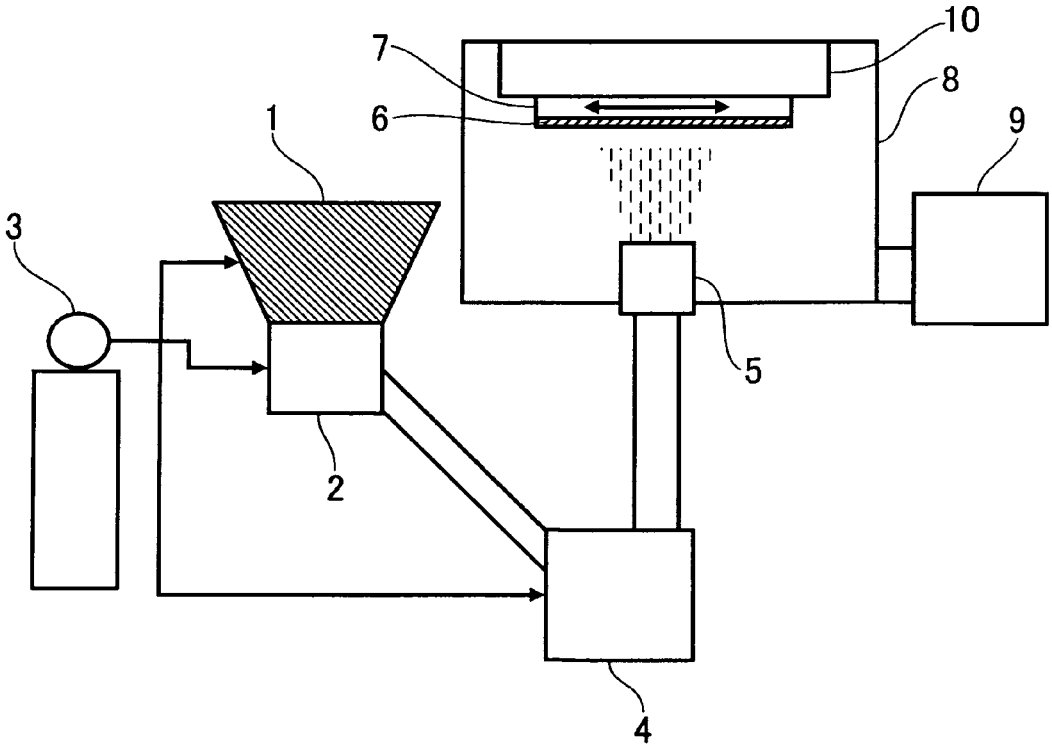
FIG. 5 is a schematic view for illustrating a first specific example of the composite structure formation system (aerosol deposition apparatus) according to the embodiment of the invention.

FIG. 5 is a schematic view for illustrating a first specific example of the composite structure formation system (aerosol deposition apparatus) according to the embodiment of the invention.

The same components as those described with reference to FIG. 1 are labeled with like reference numerals, and the description thereof is omitted.

This specific example includes a structure formation chamber 8. The discharge port 5, at least in its tip portion, and a support scan mechanism 10 for supporting a substrate 7 are placed in the structure formation chamber 8. The substrate 7 carried into the structure formation chamber 8 is supported by, for instance, an electrostatic chuck incorporated in the support scan mechanism 13.

The internal space of the structure formation chamber 8 can be maintained in a reduced-pressure state by an evacuation mechanism 9. The evacuation mechanism 9 can illustratively be a rotary pump, and can maintain a reduced-pressure atmosphere, which has a lower pressure than the atmospheric pressure, inside the structure formation chamber 8.

The aerosol generated in the aerosolation mechanism 4 is sprayed from the discharge port 5 toward the substrate 7, and a film-like structure 6 made of raw material fine particles is formed on the substrate 7. Here, because of the reduced-pressure environment in the structure formation chamber 8, the aerosol is accelerated by the pressure difference and collides with the substrate 7. Consequently, a robust film-like structure can be formed on the substrate 7 as described above.

Furthermore, by maintaining the structure formation chamber 8 in a reduced-pressure state, the "new surface" formed by collision of the aerosol with the substrate 7 can be maintained in an active state for a longer period of time, which serves to increase the compactness and strength of the film-like structure.

Furthermore, a film-like structure 6 can be formed while the substrate 7 is supported on the support scan mechanism 10 to suitably move its position in at least one of XYZθ directions. That is, by spraying the aerosol while suitably scanning the substrate 7 by the support scan mechanism 10, a film-like structure 6 can be formed on the surface of the substrate 7 having a larger area than the beam size of the aerosol sprayed from the discharge port 5.

According to this specific example, particles clusters adjusted to a prescribed shape are stored in the storage mechanism 1, and reliably supplied by the supply mechanism 2. Thus, the supply quantity can be readily made quantitative. Thus, the fine particle concentration in the aerosol can be made constant. Consequently, in the case where the discharge port 5 and the substrate 7 are relatively scanned to form a film-like structure 6 on the surface of a large-area substrate 7, the fine particle concentration in the aerosol can be kept constant. Hence, the film thickness and film quality can be made uniform across a large area.

Figure 6:
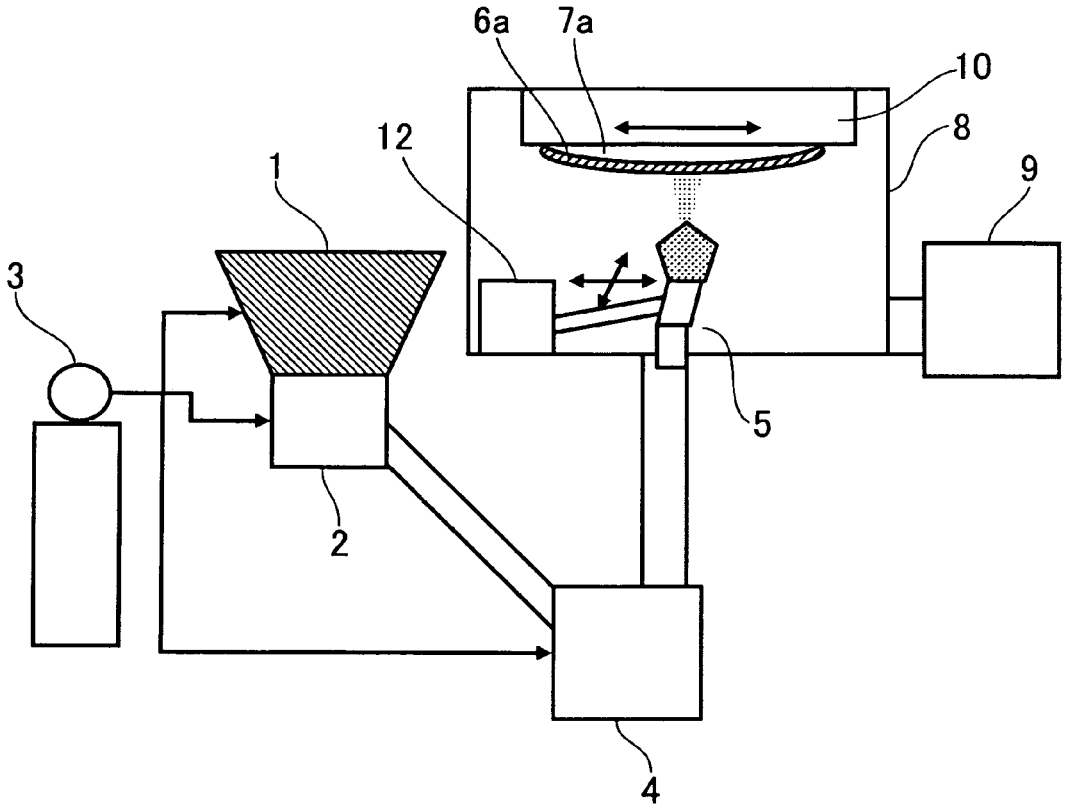
FIG. 6 is a schematic view for illustrating a second specific example of the composite structure formation system (aerosol deposition apparatus) according to the embodiment of the invention.

FIG. 6 is a schematic view for illustrating a second specific example of the composite structure formation system (aerosol deposition apparatus) according to the embodiment of the invention.

The same components as those described with reference to FIGS. 1 and 5 are labeled with like reference numerals, and the description thereof is omitted.

Also in this specific example, particle clusters inside the storage mechanism 1 are supplied to the aerosolation mechanism 4 by the supply mechanism 2. In addition, this specific example further includes a discharge port 11 having an accelerating means and a flow regulating means, not shown, and a support scan mechanism 12 is connected to the discharge port 11. The aerosol generated in the aerosolation mechanism 4 is passed through a duct 13 and sprayed from the discharge port 11 toward a substrate 7*a*. The aerosol can be accelerated using the accelerating means, not shown, included in the discharge port 11, or using the jet stream, compression effect and the like achieved by providing a difference in the flow channel diameter.

In this specific example, the discharge port 11 is supported by the support scan mechanism 12 and allowed to move in at least one of XYZθ directions. Depending on such cases where the substrate 7*a* has a solid shape or has scattered locations at which to form a film-like structure 6*a*, the aerosol is sprayed while the discharge port 11 is moved with the linear distance between the discharge port 11 and the substrate 7*a* surface being kept, and thus a film-like structure 6*a* being uniform across a large area can be formed on the substrate 7*a*. Here, if the duct 13 is flexible, the displacement due to the movement of the discharge port 11 can be absorbed. Examples of the flexible duct 13 include a duct made of an elastic material such as rubber and a duct such as a bellows. In addition, the discharge port 11 and the substrate 7*a* only need to move relatively, and the support scan mechanism 10 may be allowed to move in at least one of XYZθ directions.

Also in this specific example, particles clusters adjusted to a prescribed shape are stored in the storage mechanism 1, and reliably supplied by the supply mechanism 2. Thus, the supply quantity can be readily made quantitative. Thus, the fine particle concentration in the aerosol can be made constant. Consequently, also in the case where the discharge port 11 and the substrate 7*a* are relatively scanned to form a film-like structure 6*a* on the surface of the substrate 7*a* having a solid shape or having scattered locations at which to form the film-like structure 6*a*, the fine particle concentration in the aerosol can be kept constant. Hence, the film thickness and film quality can be made uniform across a large area.

Figure 7:
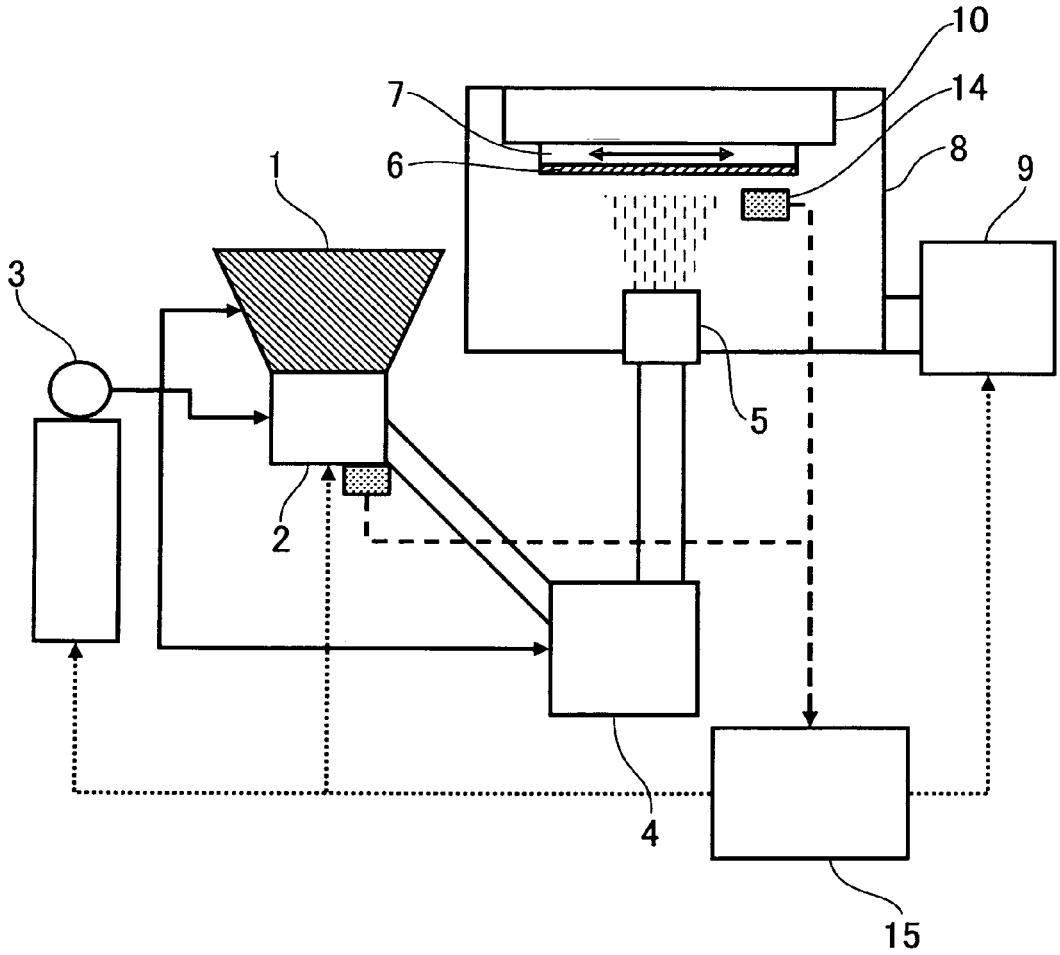
FIG. 7 is a schematic view for illustrating a third specific example of the composite structure formation system (aerosol deposition apparatus) according to the embodiment of the invention.

FIG. 7 is a schematic view for illustrating a third specific example of the composite structure formation system (aerosol deposition apparatus) according to the embodiment of the invention.

The same components as those described with reference to FIGS. 1 and 5 are labeled with like reference numerals, and the description thereof is omitted.

In this specific example, a measuring mechanism 14 for measuring the fine particle concentration in the aerosol is provided between the discharge port 5 and the substrate 7. The measuring mechanism 14 is electrically connected to a control mechanism 15. The control mechanism 15 is electrically connected also to the supply mechanism 2, the gas supply mechanism 3, and the evacuation mechanism 9 for the feedback control described later. In the connection for the feedback control described later, it is only necessary to provide electrical connection to at least the supply mechanism 2.

The measuring mechanism 14 can be provided at a location where the quantity of fine particles or the concentration of fine particles contained in the aerosol can be measured. Here, for instance, as shown in FIG. 7, the measuring mechanism 14 may be provided outside or inside the structure formation chamber 8, or inside and outside the structure formation chamber 8. The number of measuring mechanisms 14 provided can also be suitably varied.

In this specific example, the concentration of fine particles contained in the aerosol sprayed from the discharge port 5 is measured by the measuring mechanism 14, and the measured information is transmitted from the measuring mechanism 14 to the control mechanism 15. On the basis of the transmitted information, the control mechanism 15 performs feedback control on the supply mechanism 2, the gas supply mechanism 3, and the evacuation mechanism 9. Here, it is only necessary to perform feedback control at least on the supply mechanism 2.

Figure 8:
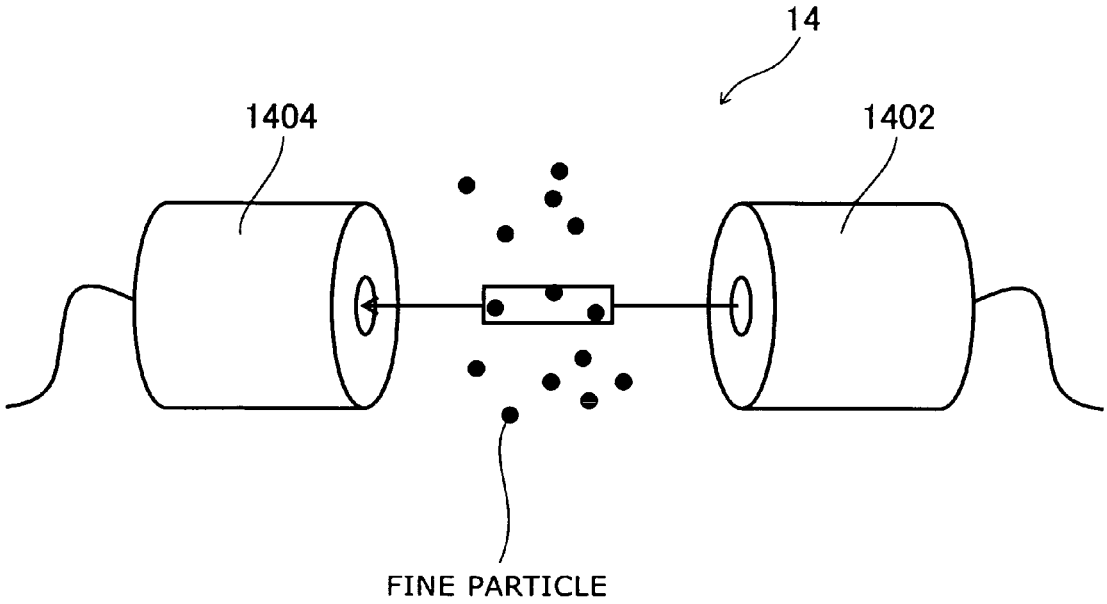
FIG. 8 is a schematic view illustrating a measuring mechanism which can be used in this embodiment.

FIG. 8 is a schematic view illustrating a measuring mechanism which can be used in this embodiment.

As shown in FIG. 8, the measuring mechanism 14 can illustratively include a light projection means 1402 such as a laser and a light receiving means 1404 for monitoring the light. In this case, the concentration of fine particles contained in the aerosol can be measured by irradiating the aerosol with laser light from the light projection means 1402 and monitoring the quantity of transmission thereof.

Figure 9:
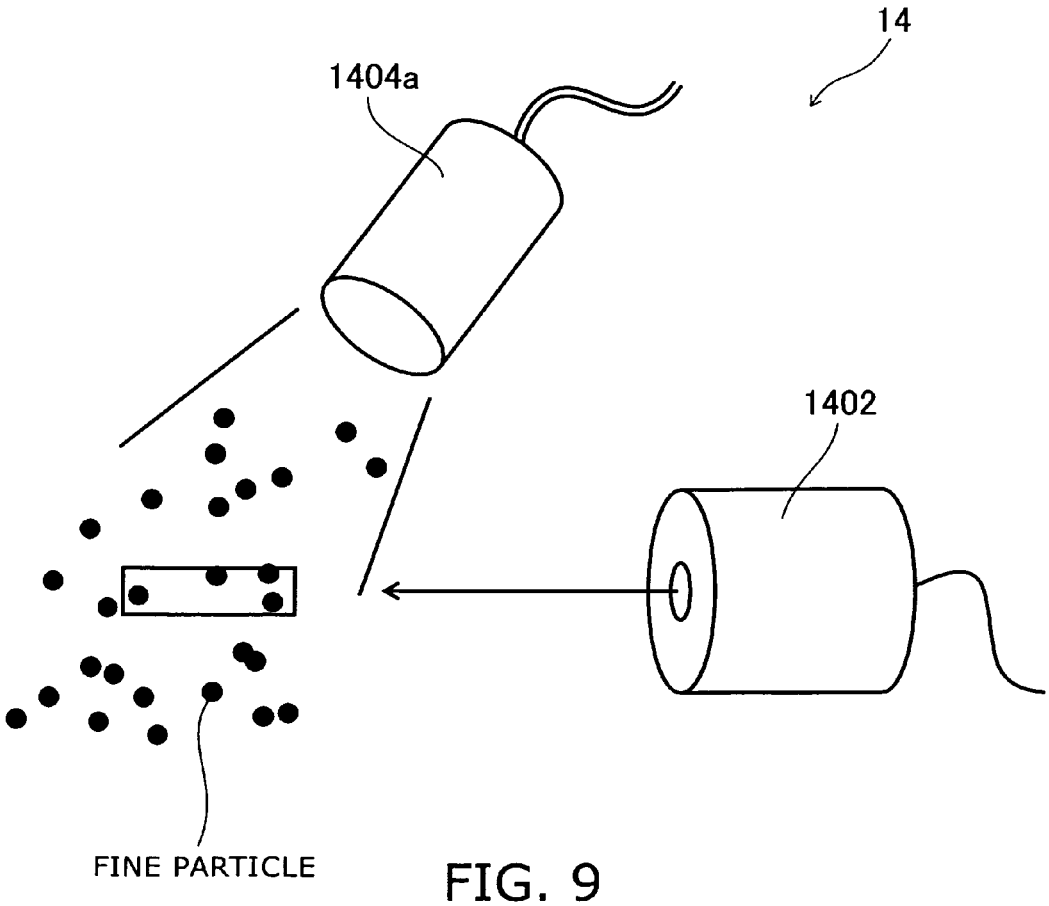
FIG. 9 is a schematic view illustrating a measuring mechanism which can be used in this embodiment.

Alternatively, as illustrated in FIG. 9, the aerosol may be irradiated with laser light from the light projection means 1402 such as a laser, and the reflected light may be monitored by a light receiving means 1404*a* such as a CCD (charge coupled device) sensor.

Figure 10:
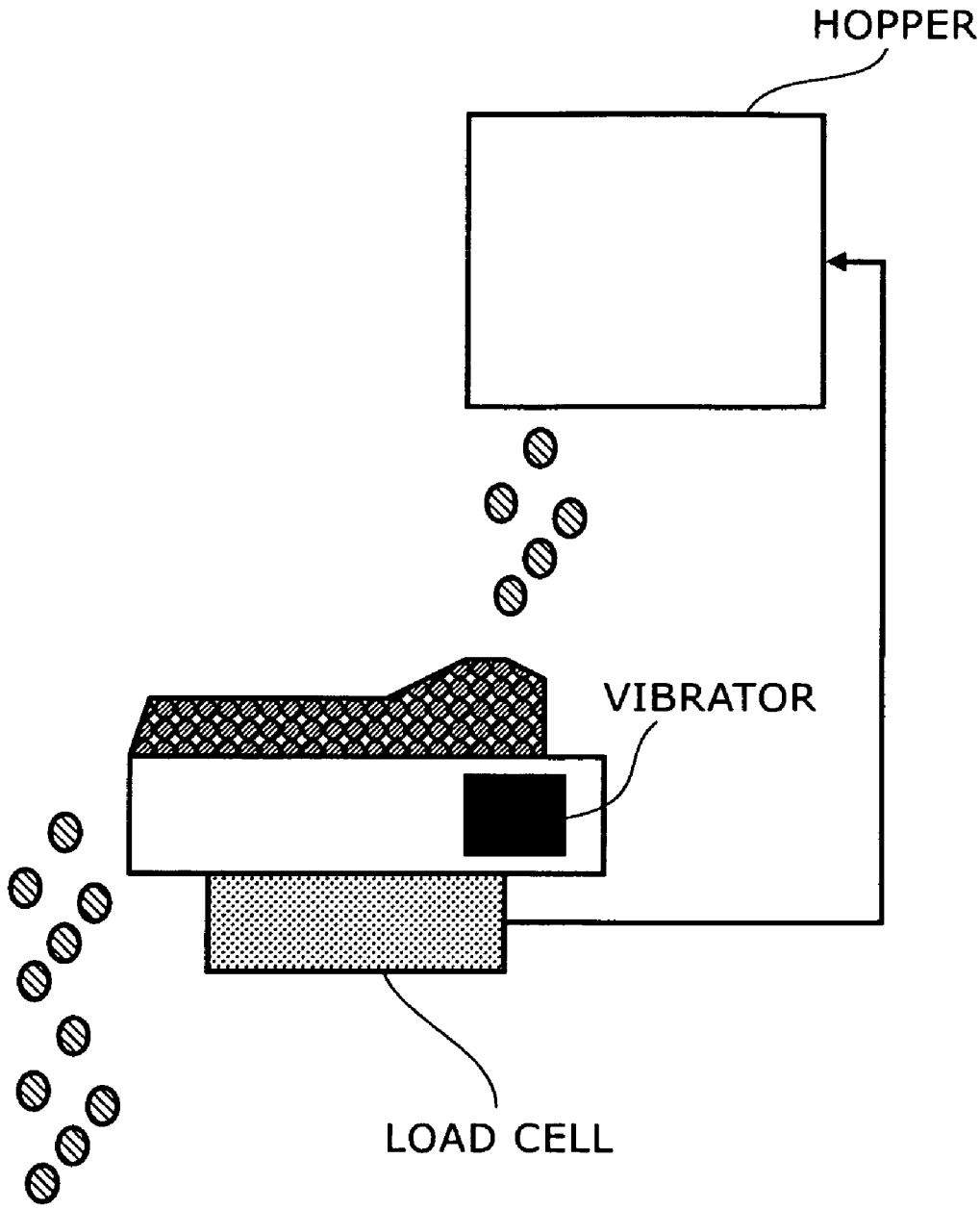
FIG. 10 is a schematic view illustrating a measuring mechanism which can be used in this embodiment.

Alternatively, as illustrated in FIG. 10, the supply mechanism 2 can be provided with a load cell to measure the weight change of the supply mechanism 2, thereby measuring the supply quantity. By varying the amplitude and the like of a vibrator in accordance with the weight change, particle clusters can be always supplied in a constant weight. In this case, for higher readability of the weight change, a multi-stage supply mechanism 2 can be used to measure and control the supply quantity with higher precision.

Also in this specific example, particles clusters adjusted to a prescribed shape are stored in the storage mechanism 1, and reliably supplied by the supply mechanism 2. Thus, the supply quantity can be readily made quantitative. Thus, the fine particle concentration in the aerosol can be made constant.

Furthermore, the measuring mechanism 14 is provided, and the control mechanism 15 performs feedback control at least on the supply mechanism 2. Thus, even if any fluctuation or temporal variation occurs in the concentration of fine particles contained in the sprayed aerosol, the concentration of fine particles contained in the aerosol can be accurately controlled.

Consequently, the fine particle concentration in the aerosol can be kept constant. Hence, the film thickness and film quality can be made uniform across a large area.

The overall configuration of the composite structure formation system (aerosol deposition apparatus) according to the embodiment of the invention has been illustrated.

Next, specific examples of the supply mechanism 2 are illustrated.

Figure 11:
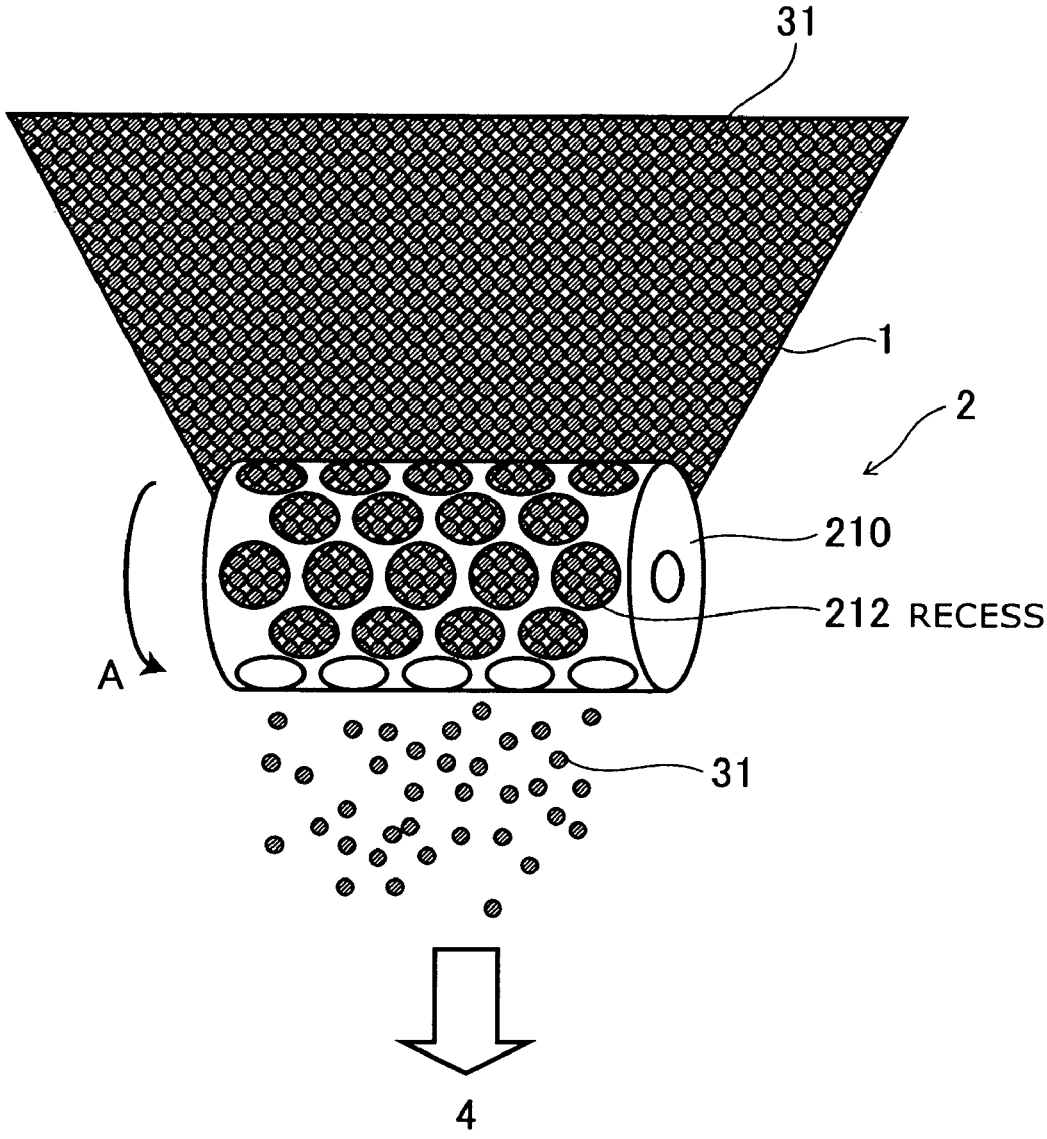
FIG. 11 is a schematic view for illustrating a first specific example of the supply mechanism.

FIG. 11 is a schematic view for illustrating a first specific example of the supply mechanism 2.

More specifically, FIG. 11 is a schematic perspective view of a relevant part of the supply mechanism 2.

In this specific example, an opening is provided at the vertical bottom of the storage mechanism 1 storing particle clusters 31, and a roller 210 is provided so as to occlude this opening. The roller 210 has a plurality of recesses 212 on its surface, and rotates in the direction of arrow A or in the direction opposite thereto. The recess 212 has a capacity sufficiently larger than the particle cluster 31. The gap between the inner sidewall of the storage mechanism 1 and the surface of the roller 210 is sufficiently narrowed as long as the rotation of the roller 210 is not hampered, so that particle clusters 31 do not drop out of this gap. Here, an elastic seal such as rubber may be provided on the inner sidewall or opening end of the storage mechanism 1 so as to be in contact with the surface of the roller 210.

In the storage mechanism 1, particle clusters 31 are filled by their self-weight in the recess 212 of the roller 210, and carried out to the outside (downside) of the storage mechanism 1 by the rotation of the roller 210. When the recess 212 is directed vertically downward, the particle clusters 31 fall by self-weight. By providing the aerosolation mechanism 4 at this falling destination, an aerosol having a constant concentration of fine particles can be formed.

In this specific example, a prescribed quantity of particle clusters 31 filled in the recess 212 are carried out of the storage mechanism 1 in response to the rotation of the roller 210 and fall toward the aerosolation mechanism 4. That is, a prescribed quantity of particle clusters 31 can be successively supplied.

Furthermore, in the storage mechanism 1, the particle clusters 31 are filled by their self-weight in the recess 212 of the roller 210, and hence not excessively packed down. That is, the particle clusters 31 are carried out without collapse. Thus, it is possible to prevent particle clusters 31 with altered shape from being supplied from the supply mechanism 2.

Furthermore, because the particle clusters 31 are not excessively packed down into the recess 212, the particle clusters 31 therein can smoothly fall by self-weight when the recess 212 is directed vertically downward by the rotation of the roller 210. That is, it is also possible to avoid the problem of the particle clusters 31 failing to fall from inside the recess 212, and the particle clusters 31 can be stably supplied. Hence, the particle clusters 31 with the spatula angle adjusted can be directly supplied, thereby stabilizing the transport quantity. Thus, stable supply as planed can be achieved without stacking.

Figure 12:
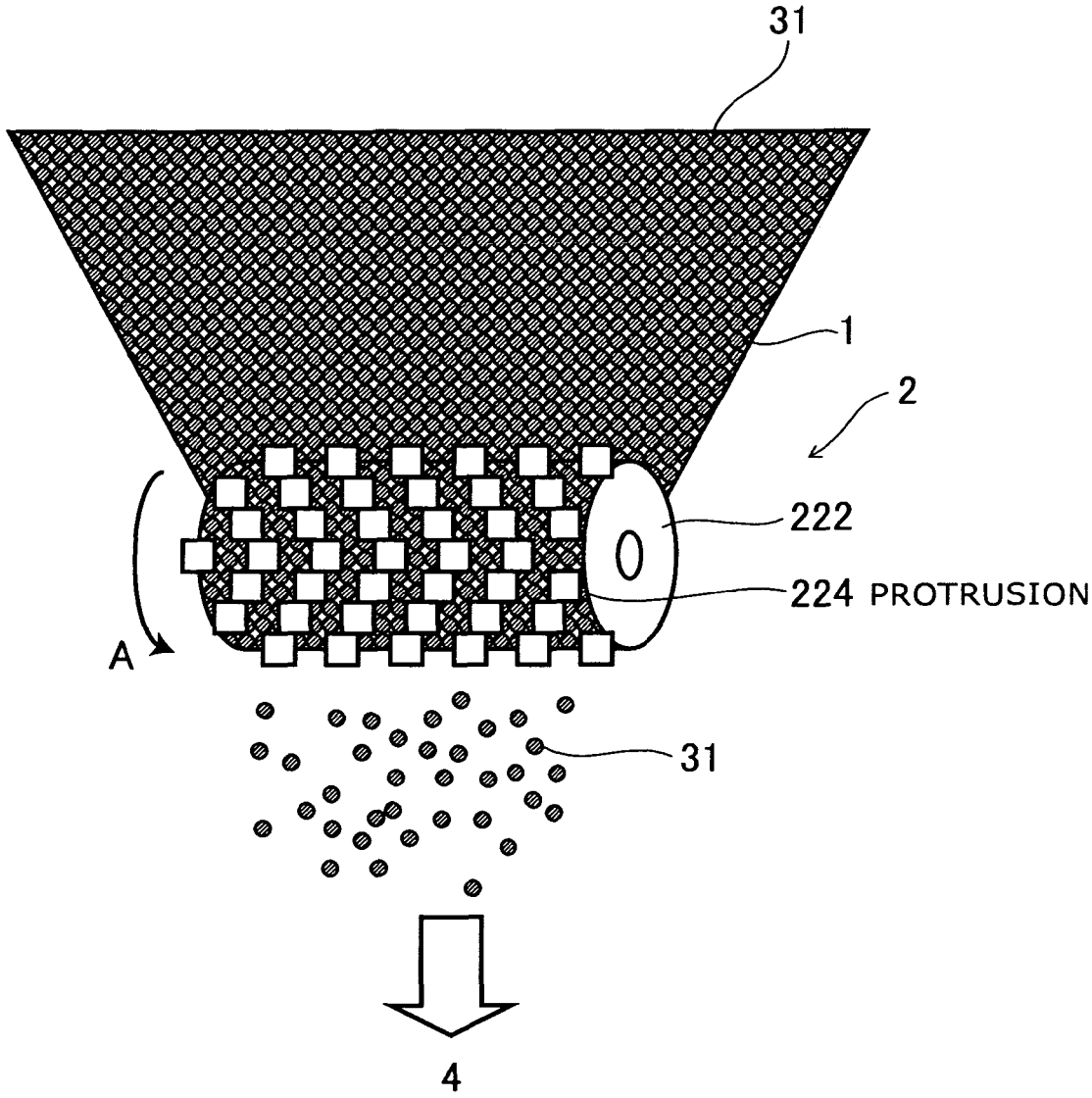
FIG. 12 is a schematic view for illustrating a second specific example of the supply mechanism.

FIG. 12 is a schematic view for illustrating a second specific example of the supply mechanism 2.

Also in this specific example, an opening is provided at the vertical bottom of the storage mechanism 1 storing particle clusters 31. Furthermore, a roller 222 is provided so as to occlude this opening. The roller 222 has a plurality of protrusions 224 on its surface, and rotates in the direction of arrow A or in the direction opposite thereto.

In this specific example, because the protrusions 224 are provided on the surface of the roller 222, a gap corresponding to the height of the protrusion 224 occurs between the surface of the roller 222 and the inner sidewall of the storage mechanism 1. However, by providing the protrusions 224 relatively densely on the surface of the roller 222 or suitably adjusting the shape and arrangement of the protrusions 224, particle clusters 31 can be prevented from continuously dropping out of the gap between the opening at the lower end of the storage mechanism 1 and the surface of the roller 222.

In response to the rotation of the roller 222, particle clusters 31 stored in the storage mechanism 1 are pushed out by the protrusions 224, fall by self-weight, and are supplied to the aerosolation mechanism 4. The particle clusters 31 stored in the storage mechanism 1 are ejected as if they are scraped out by each protrusion 224. Hence, the quantity of particle clusters 31 can be controlled by the shape and frequency of the protrusions 224, and the rotation speed.

In this specific example, in the storage mechanism 1, the particle clusters 31 are in contact with the surface of the roller 222 by their self-weight, and pushed out by the protrusions 224. Hence, the particle clusters 31 are not excessively packed down. That is, the particle clusters 31 are carried out without collapse. Thus, it is possible to prevent particle clusters 31 with altered shape from being supplied from the supply mechanism 2. Hence, the particle clusters 31 with the spatula angle adjusted can be directly supplied, thereby stabilizing the transport quantity. Thus, stable supply on target can be achieved without stacking.

Figure 13:
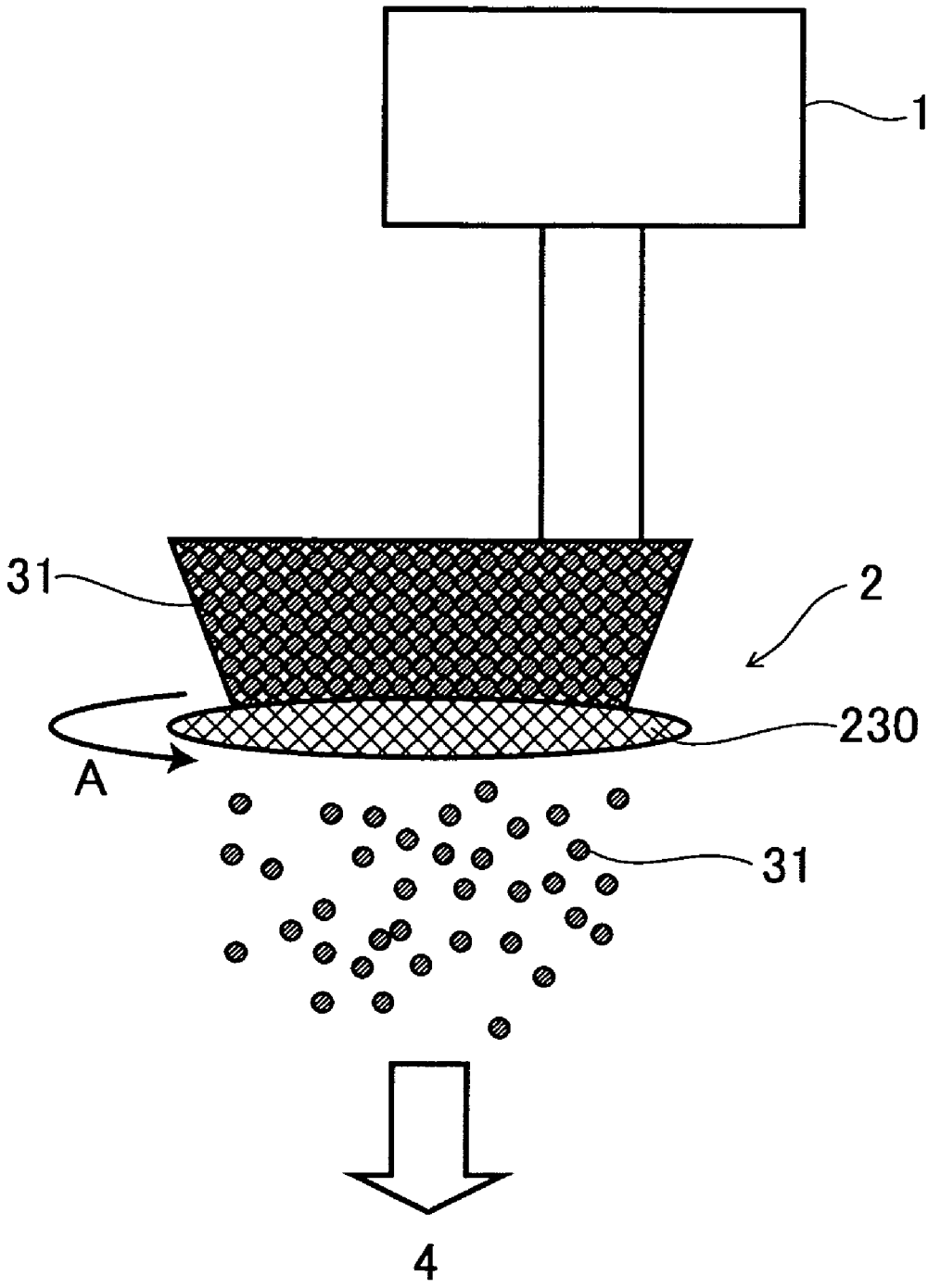
FIG. 13 is a schematic view for illustrating a third specific example of the supply mechanism.

FIG. 13 is a schematic view for illustrating a third specific example of the supply mechanism 2.

In this specific example, a generally circular opening is provided at the vertical bottom of the storage mechanism 1 storing particle clusters 31. Furthermore, a mesh 230 is provided at this opening. The mesh 230 rotates in the direction of arrow A or in the direction opposite thereto while being in contact with the bottom of the storage mechanism 1.

In this specific example, by the rotation of the mesh 230, particle clusters 31 fall through the openings of the mesh 230. The falling quantity of particle clusters 31 depends on the opening size, rotation speed and the like of the mesh 230. Here, if the opening size of the mesh is in the range from 2 to 7 times the mean particle diameter of the particle cluster 31, the particle clusters 31 can be bridged over each other when the mesh 230 is at rest, and hence unnecessary fall can be avoided. Consequently, the transport quantity of particle clusters 31 can be readily controlled by the rotation of the mesh 230.

In this specific example, in the storage mechanism 1, the particle clusters 31 are in contact with the surface of the mesh 230 by their self-weight, and fall outside through the openings. Hence, the particle clusters 31 are not excessively packed down. That is, the particle clusters 31 are carried out without collapse. Thus, it is possible to prevent particle clusters 31 with altered shape from being supplied from the supply mechanism 2. Hence, the particle clusters 31 with the spatula angle adjusted can be directly supplied, thereby stabilizing the transport quantity. Thus, stable supply on target can be achieved without stacking.

Furthermore, a plurality of particle clusters 31 are supplied nearly simultaneously and continuously through a plurality of openings of the mesh 230. That is, in the aerosolation mechanism 4, numerous particle clusters 31 are always supplied continuously, and the supply quantity of particle clusters 31 is averaged in terms of time. Thus, in the aerosolation mechanism 4, a constant quantity of particle clusters 31 are always supplied stably, and hence an aerosol having a constant fine particle concentration can be stably generated.

Figure 14:
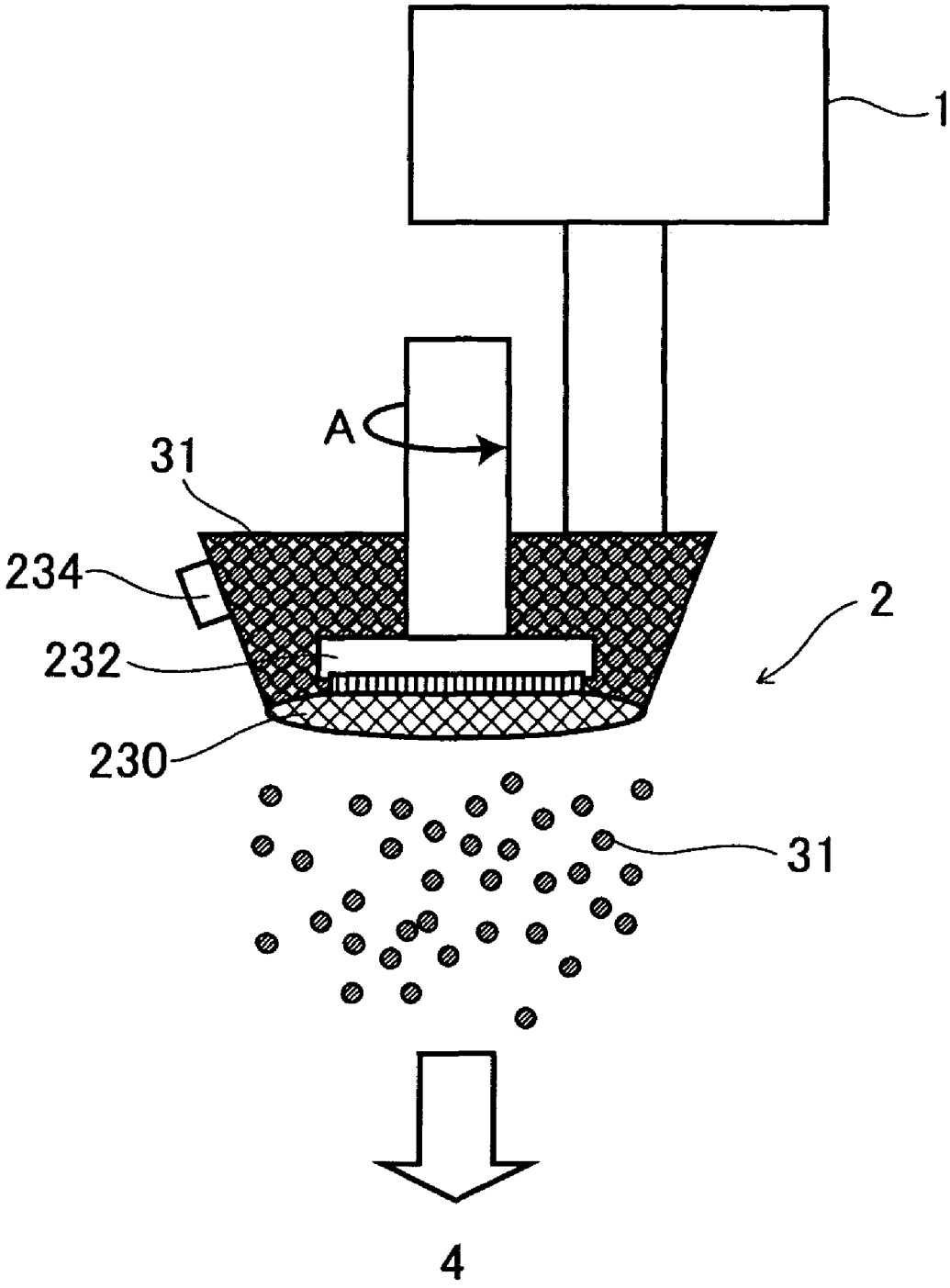
FIG. 14 is a schematic view for illustrating a fourth specific example of the supply mechanism.

FIG. 14 is a schematic view for illustrating a fourth specific example of the supply mechanism 2.

Also in this specific example, like that described above with reference to the third specific example, a circular opening is provided at the vertical bottom of the storage mechanism 1 storing particle clusters 31. Furthermore, a mesh 230 is provided at this opening. A brush 232 is placed on the mesh 230, and rotates in the direction of arrow A or in the direction opposite thereto while being in contact with the mesh 230. Furthermore, a vibrator 234 is attached to the storage mechanism 1. The vibrator 234 vibrates the wall surface and the like of the storage mechanism 1, serving to smoothly drop and supply the particle clusters 31 stored in the storage mechanism 1 toward the brush 232 and the mesh 230. Furthermore, by applying vibration to the particle clusters 31 in the storage mechanism 1, the effect of enhancing their fluidity is also achieved.

Also in the first to third specific example, the vibrator 234 can be provided likewise to achieve the same operation and effect.

In this specific example, in response to the rotation of the brush 232, particle clusters 31 fall through the openings of the mesh 230. The falling quantity of particle clusters 31 depends on the opening size of the mesh 230 and the bristle density and rotation speed of the brush 232. Here, if the opening size of the mesh is in the range from 2 to 7 times the mean particle diameter of the particle cluster 31, the particle clusters 31 can be bridged over each other when the mesh 230 is at rest, and hence unnecessary fall can be avoided. Consequently, the transport quantity of particle clusters 31 can be readily controlled by the rotation of the mesh 230.

In response to the motion of each bristle tip of the brush 232 passing through the opening of the mesh 230, particle clusters 31 are pushed out of the opening. Microscopically, the particle clusters 31 are lightly pushed out of the mesh, dropped, and supplied to the aerosolation mechanism 4. That is, the particle clusters 31 are carried out without collapse. Thus, it is possible to prevent particle clusters 31 with altered shape from being supplied from the supply mechanism 2. Hence, the particle clusters 31 with the spatula angle adjusted can be directly supplied, thereby stabilizing the transport quantity. Thus, stable supply as planed can be achieved without stacking.

Furthermore, a plurality of particle clusters 31 are supplied nearly simultaneously and continuously through a plurality of openings of the mesh 230. That is, in the aerosolation mechanism 4, numerous particle clusters 31 are always supplied continuously, and the supply quantity of particle clusters 31 is averaged in terms of time. Thus, in the aerosolation mechanism 4, a constant quantity of particle clusters 31 are always supplied stably, and hence an aerosol having a constant fine particle concentration can be stably generated.

Figure 15:
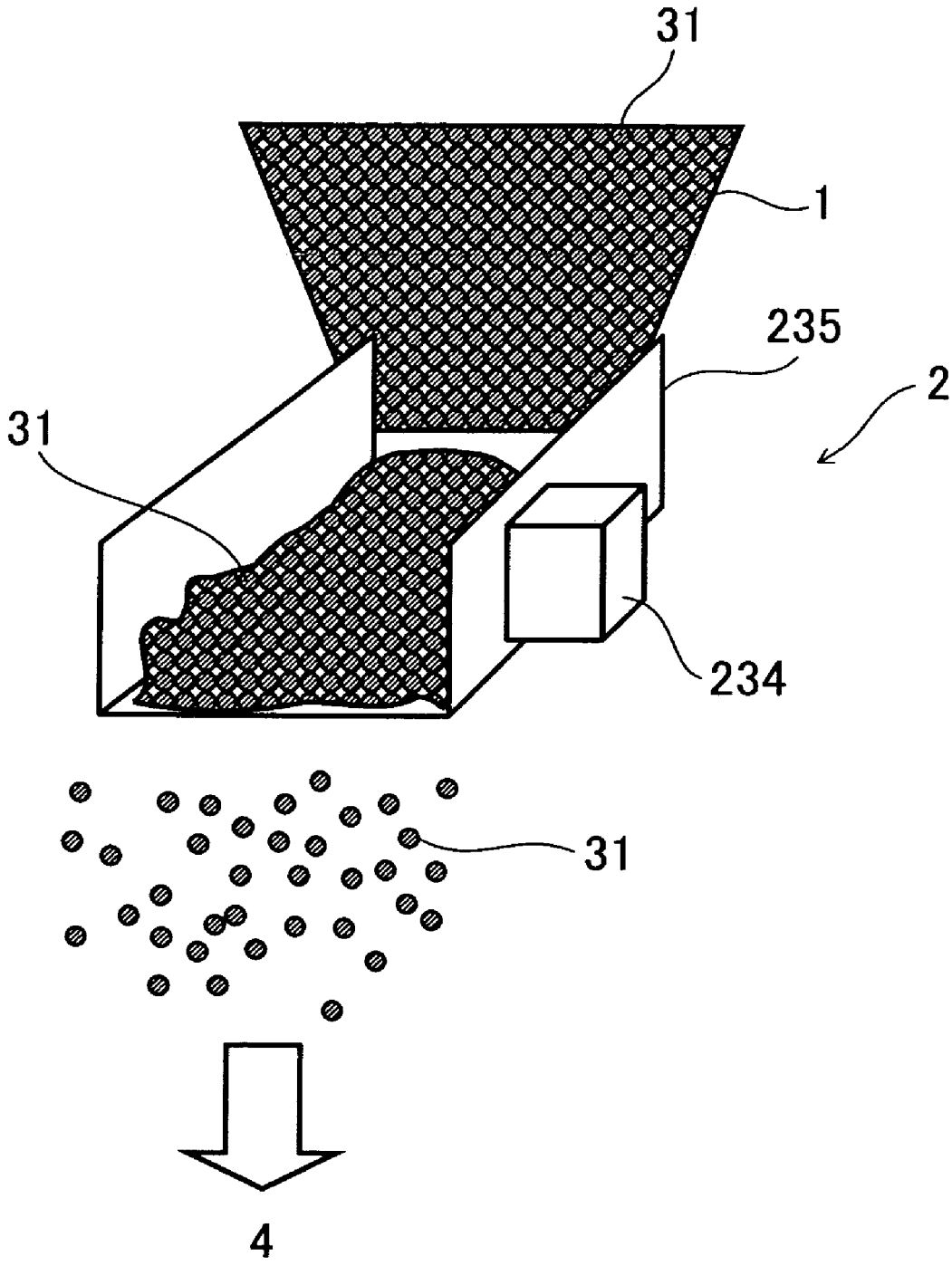
FIG. 15 is a schematic view for illustrating a fifth specific example of the supply mechanism.

FIG. 15 is a schematic view for illustrating a fifth specific example of the supply mechanism 2.

In this specific example, a supply channel 235 is provided below the storage mechanism 1 storing particle clusters 31, and a vibrator 234 is placed on the supply channel 235. The particle clusters 31 stored in the storage mechanism 1 pass through an orifice, not shown, and a prescribed quantity of particle clusters 31 are supplied to the supply channel 235.

The particle clusters 31 supplied to the supply channel 235 are carried out of the supply channel 235 by vibration of the vibrator 234.

In this specific example, in the storage mechanism 1, the particle clusters 31 are passed through the orifice, not shown, by their self-weight and dropped outside (to the supply channel 235). Hence, the particle clusters 31 are not excessively packed down. Likewise, the particle clusters 31 supplied to the supply channel 235 are dropped outside by vibration of the vibrator 234, and hence the shape of the particle cluster 31 does not change. That is, the particle clusters 31 are supplied from the supply mechanism 2 to the outside without change in their shape. Hence, the particle clusters 31 with the spatula angle adjusted can be directly supplied, thereby stabilizing the transport quantity. Thus, stable supply as planed on target can be achieved without stacking.

Furthermore, a plurality of particle clusters 31 are supplied nearly simultaneously and continuously. That is, in the aerosolation mechanism 4, numerous particle clusters 31 are always supplied continuously, and the supply quantity of particle clusters 31 is averaged in terms of time. Thus, in the aerosolation mechanism 4, a constant quantity of particle clusters 31 are always supplied stably, and hence an aerosol having a constant fine particle concentration can be stably generated.

Figure 16:
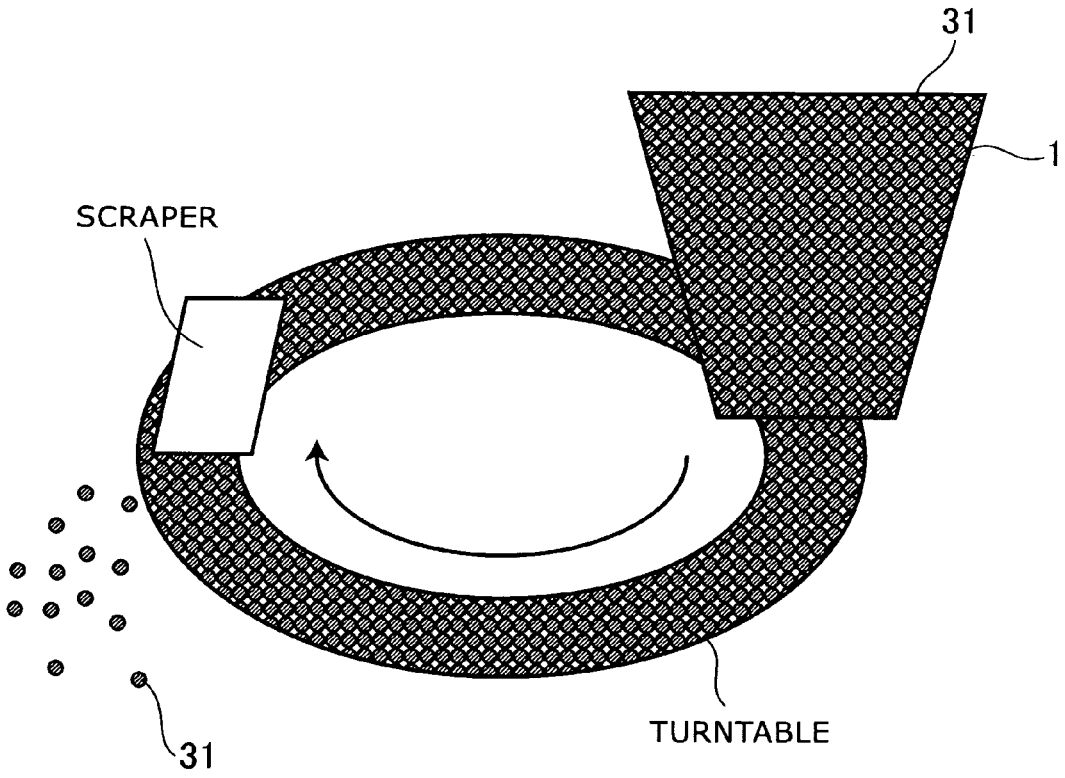
FIG. 16 is a schematic view for illustrating a sixth specific example of the supply mechanism.

FIG. 16 is a schematic view for illustrating a sixth specific example of the supply mechanism 2.

In this specific example, a turntable provided with grooves is placed below the storage mechanism-1 storing particle clusters 31, and a scraper is placed ahead in the rotation direction of the turntable.

The particle clusters 31 introduced into the groove of the turntable is carried out of the storage mechanism 1 by the rotation of the turntable. Then, the particle clusters 31 introduced into the groove are scraped out by the scraper.

In this specific example, in the storage mechanism 1, the particle clusters 31 are in contact with the surface of the turntable by their self-weight, introduced into the grooves, and then scraped out by the scraper. Hence, the particle clusters 31 are not excessively packed down. That is, the particle clusters 31 are carried out without collapse. Thus, it is possible to prevent particle clusters 31 with altered shape from being supplied from the supply mechanism 2. Hence, the particle clusters 31 with the spatula angle adjusted can be directly supplied, thereby stabilizing the transport quantity. Thus, stable supply as planed can be achieved without stacking.

Furthermore, a plurality of particle clusters 31 are supplied nearly simultaneously and continuously through a plurality of grooves of the turntable. That is, in the aerosolation mechanism 4, numerous particle clusters 31 are always supplied continuously, and the supply quantity of particle clusters 31 is averaged in terms of time. Thus, in the aerosolation mechanism 4, a constant quantity of particle clusters 31 are always supplied stably, and hence an aerosol having a constant fine particle concentration can be stably generated.

Figure 17:
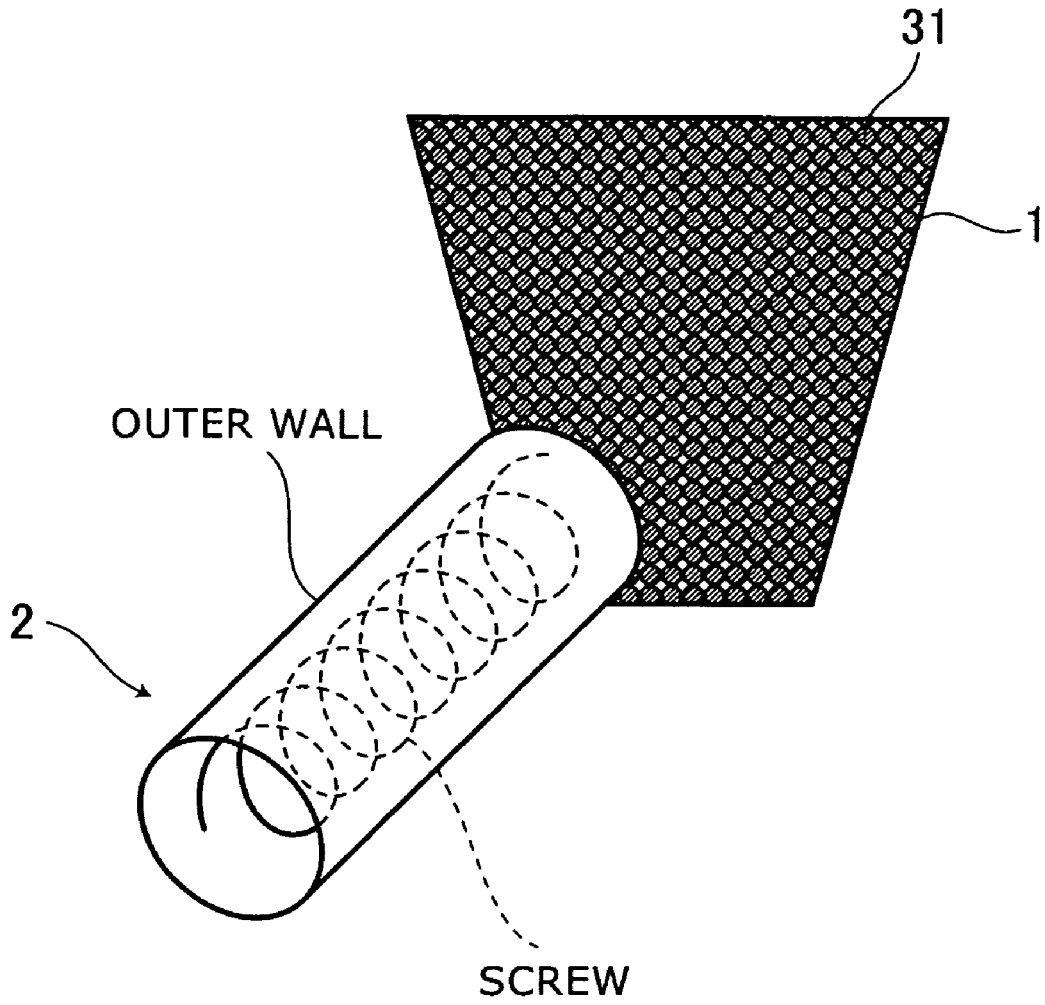
FIG. 17 is a schematic view for illustrating a seventh specific example of the supply mechanism.

FIG. 17 is a schematic view for illustrating a seventh specific example of the supply mechanism 2.

In this specific example, a screw is provided below the storage mechanism 1 storing particle clusters 31, and a motor, not shown, for rotating the screw is provided at the end of the screw. Furthermore, to smoothly rotate the screw, an outer wall having a certain length is provided on the screw, and both ends of the outer wall are opened. The particle clusters 31 introduced into the groove of the screw are supplied from the storage mechanism 1 by the rotation of the screw. At this time, the particle clusters 31 are leveled off to a constant quantity by the clearance with the outer wall, moved therethrough, and dropped from the end of the outer wall at a constant rate.

In this specific example, in the storage mechanism 1, the particle clusters 31 are in contact with the surface of the screw by their self-weight. Hence, the particle clusters 31 are not excessively packed down. That is, the particle clusters 31 are carried out without collapse. Thus, it is possible to prevent particle clusters 31 with altered shape from being supplied from the supply mechanism 2. Hence, the particle clusters 31 with the spatula angle adjusted can be directly supplied, thereby stabilizing the transport quantity. Thus, stable supply as planed can be achieved without stacking.

Furthermore, a plurality of particle clusters 31 are supplied nearly simultaneously and continuously by the screw. That is, in the aerosolation mechanism 4, numerous particle clusters 31 are always supplied continuously, and the supply quantity of particle clusters 31 is averaged in terms of time. Thus, in the aerosolation mechanism 4, a constant quantity of particle clusters 31 are always supplied stably, and hence an aerosol having a constant fine particle concentration can be stably generated.

Figure 18:
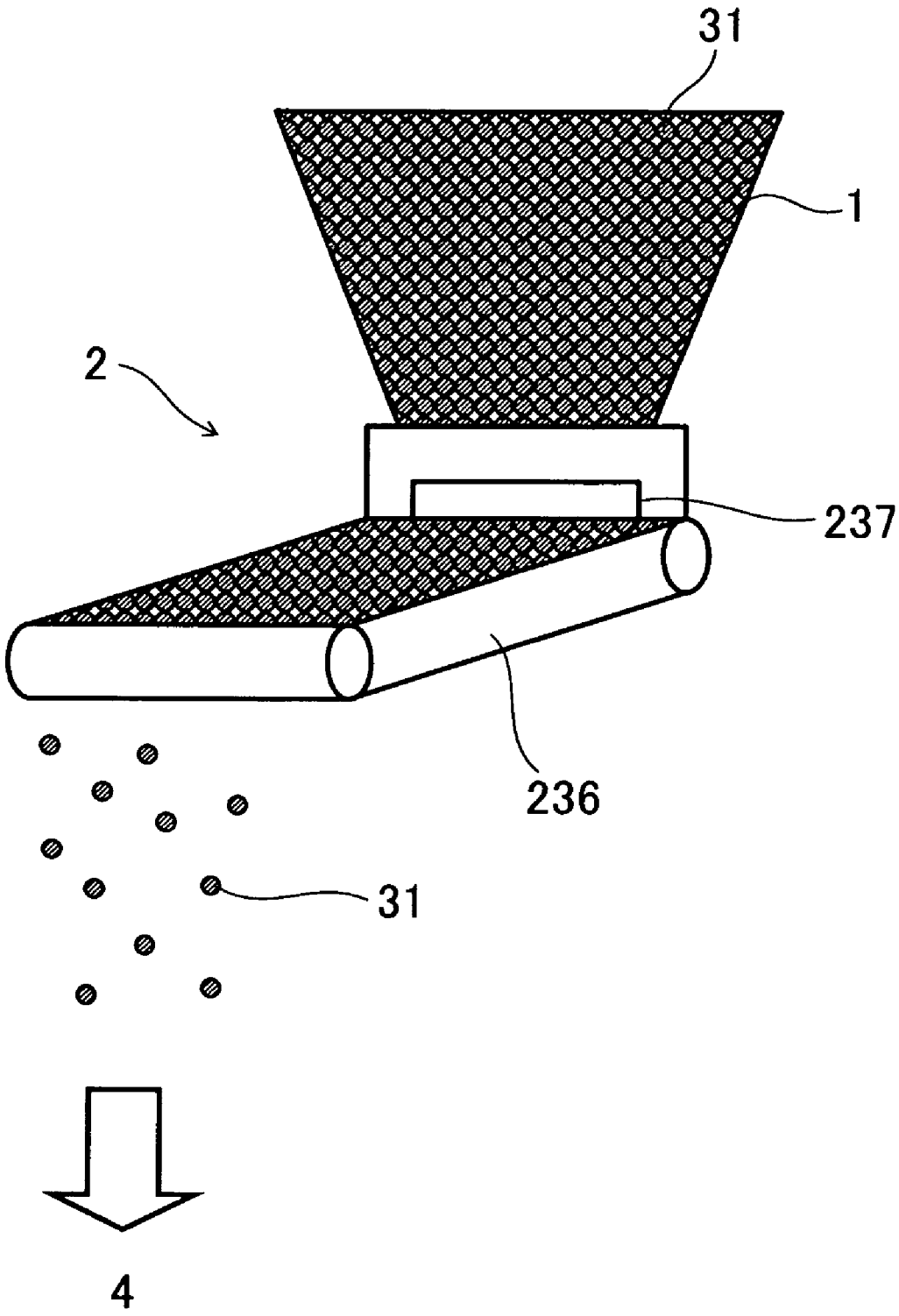
FIG. 18 is a schematic view for illustrating an eighth specific example of the supply mechanism.

FIG. 18 is a schematic view for illustrating an eighth specific example of the supply mechanism 2.

In this specific example, an orifice 237 is provided at the bottom of the storage mechanism 1 storing particle clusters 31, and a belt conveyor 236 is placed therebelow nearly horizontally with respect to the geographic axis.

The particle clusters 31 leveled off by the orifice 237 are carried out on top of the belt conveyor 236. The belt conveyor 236 is driven at a constant speed. Hence, after being moved a prescribed length, the particle clusters 31 are dropped from the end of the belt conveyor 236 at a constant rate.

In this specific example, in the storage mechanism 1, the particle clusters 31 pass through the orifice 237 and fall on the belt conveyor 236 by their self-weight. Hence, the particle clusters 31 are not excessively packed down. That is, the particle clusters 31 are carried out without collapse. Thus, it is possible to prevent particle clusters 31 with altered shape from being supplied from the supply mechanism 2. Hence, the particle clusters 31 with the spatula angle adjusted can be directly supplied, thereby stabilizing the transport quantity. Thus, stable supply as planed can be achieved without stacking.

Furthermore, a plurality of particle clusters 31 are supplied nearly simultaneously and continuously through the belt conveyor 236. That is, in the aerosolation mechanism 4, numerous particle clusters 31 are always supplied continuously, and the supply quantity of particle clusters 31 is averaged in terms of time. Thus, in the aerosolation mechanism 4, a constant quantity of particle clusters 31 are always supplied stably, and hence an aerosol having a constant fine particle concentration can be stably generated.

Figure 19:
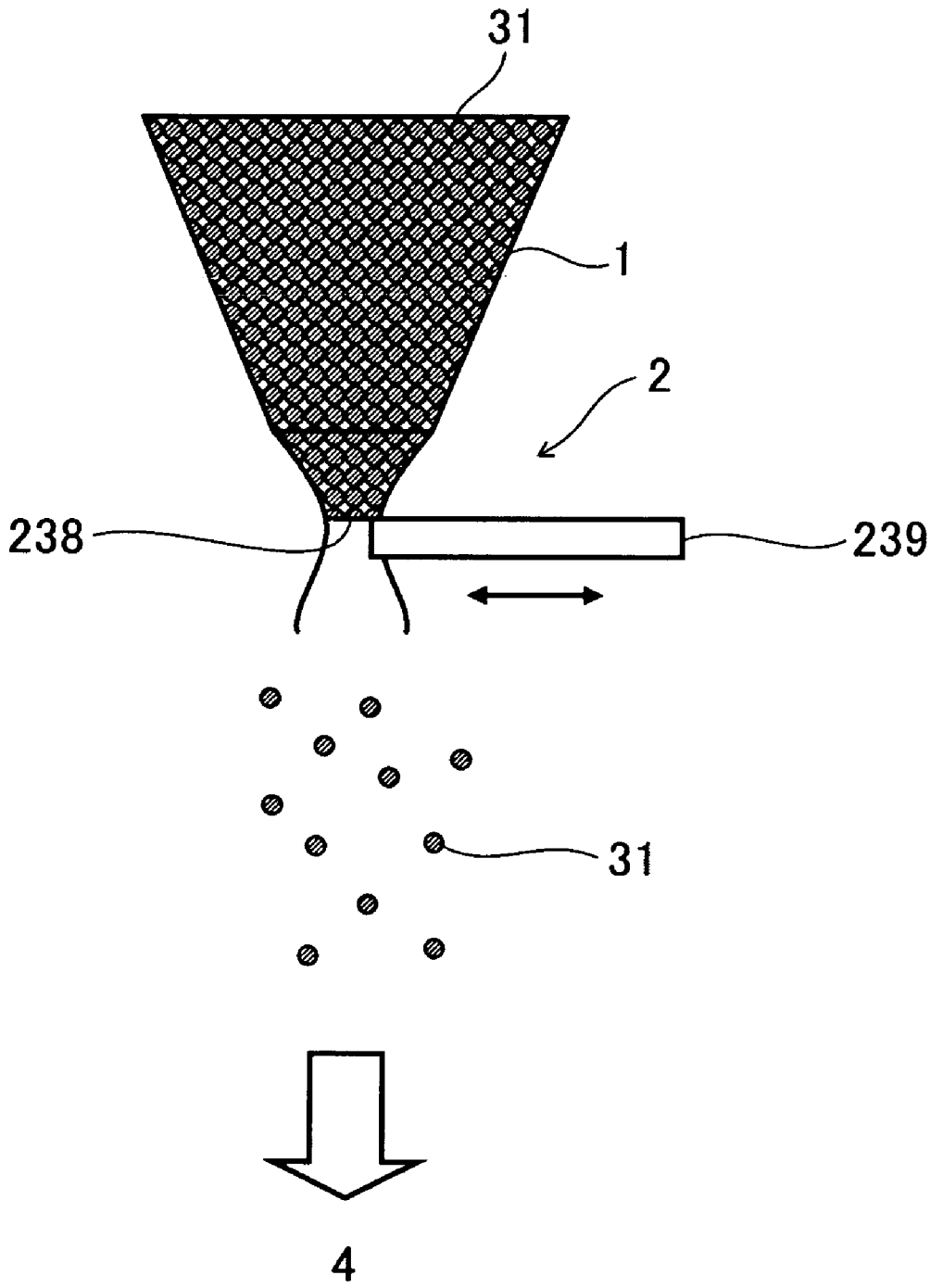
FIG. 19 is a schematic view for illustrating a ninth specific example of the supply mechanism.

FIG. 19 is a schematic view for illustrating a ninth specific example of the supply mechanism 2.

In this specific example, an orifice 238 is provided at the bottom of the storage mechanism 1 storing particle clusters 31, and a shutter 239 for opening and closing the orifice 238 is further provided. The opening shape of the orifice 238 is suitably determined in accordance with the size of the particle cluster 31. By opening and closing the shutter 239, supply of particle clusters 31 can be started and stopped.

In this specific example, in the storage mechanism 1, the particle clusters 31 pass through the orifice 238 and fall outside by their self-weight. Hence, the particle clusters 31 are not excessively packed down. That is, the particle clusters 31 are carried out without collapse. Thus, it is possible to prevent particle clusters 31 with altered shape from being supplied from the supply mechanism 2. Hence, the particle clusters 31 with the spatula angle adjusted can be directly supplied, thereby stabilizing the transport quantity. Thus, stable supply as planed can be achieved without stacking.

Furthermore, a plurality of particle clusters 31 are supplied nearly simultaneously and continuously through the orifice 238. That is, in the aerosolation mechanism 4, numerous particle clusters 31 are always supplied continuously, and the supply quantity of particle clusters 31 is averaged in terms of time. Thus, in the aerosolation mechanism 4, a constant quantity of particle clusters 31 are always supplied stably, and hence an aerosol having a constant fine particle concentration can be stably generated.

Next, the aerosolation mechanism 4 is described with reference to specific examples.

Figure 20:
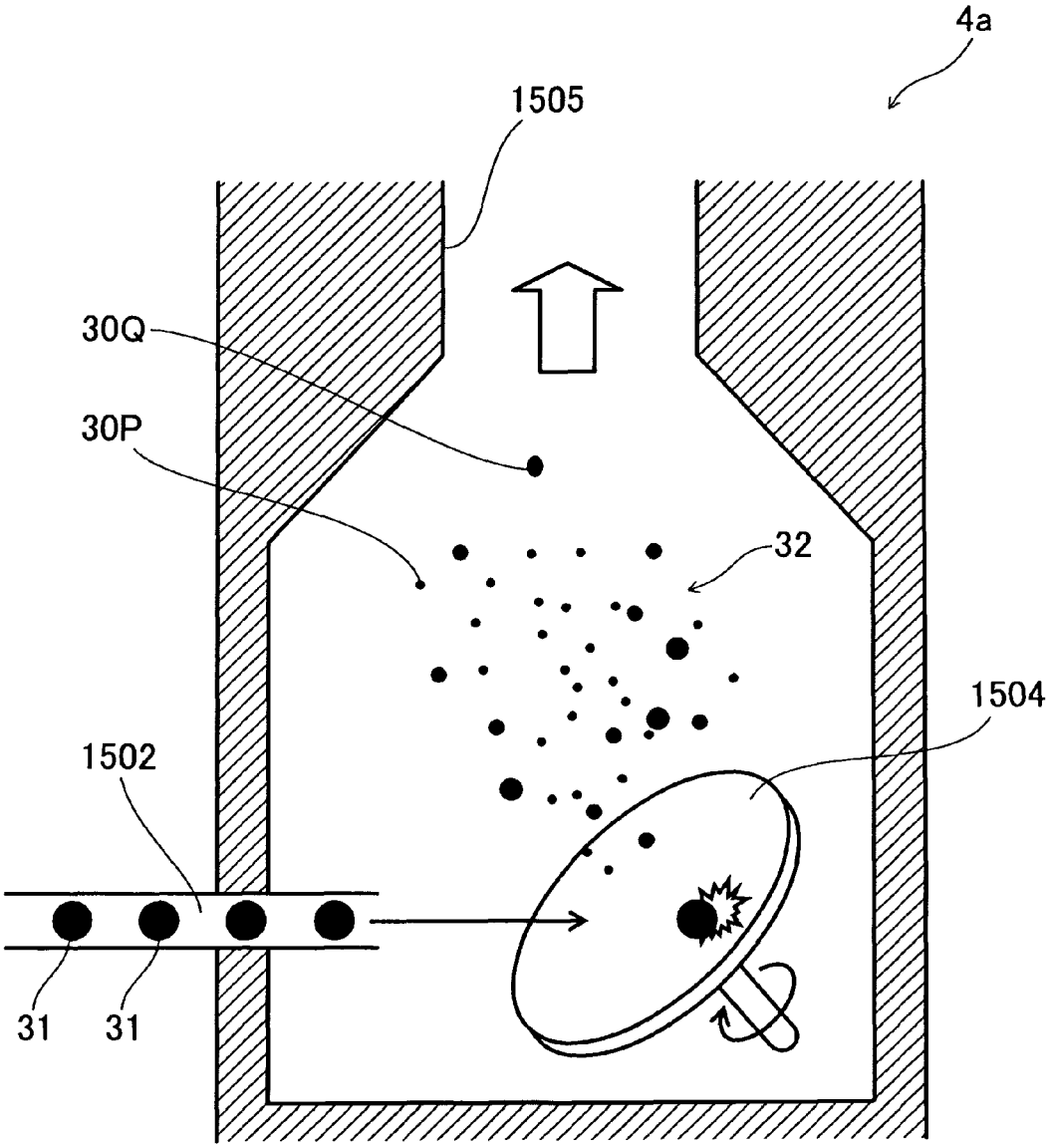
FIG. 20 is a schematic view for illustrating a first specific example of the aerosolation mechanism.

FIG. 20 is a schematic view for illustrating a first specific example of the aerosolation mechanism.

The aerosolation mechanism 4*a* includes a supply port 1502 for squirting particle clusters 31 with a gas, an impact plate 1504 provided in front thereof to serve as a mechanical barrier, and an ejection port 1505.

The particle cluster 31 squirted from the supply port 1502 receives an impact force when colliding with the impact plate 1504. This impact force disaggregates the particle cluster 31 into primary particles 30P, or aggregate grains 30Q with several primary particles 30P aggregated therein, which are dispersed in the gas to form an aerosol 32. The aerosol 32 is carried with the gas flow and ejected from the ejection port 1505.

Furthermore, by rotating the impact plate 1504, the motion vector of the particle cluster 31 at the collision point is generally opposed to the motion vector of the spray of the aerosol 32. Hence, the impact force on the particle cluster 31 can be increased. Consequently, the fine particle concentration in the aerosol 32 can be made more homogeneous.

Figure 21:
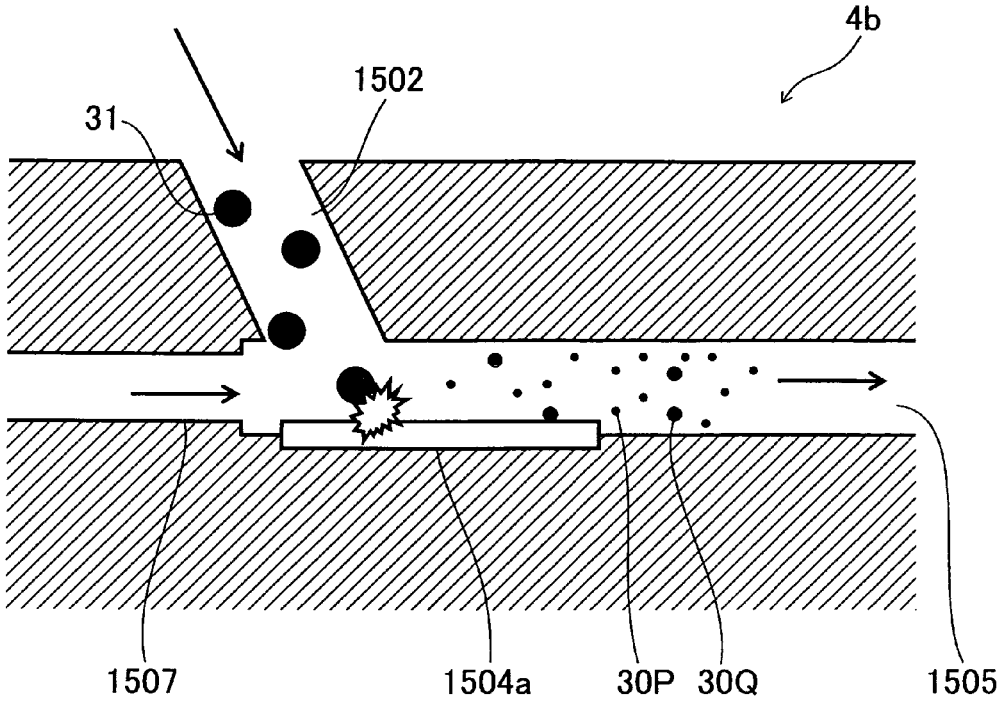
FIG. 21 is a schematic view for illustrating a second specific example of the aerosolation mechanism.

FIG. 21 is a schematic view for illustrating a second specific example of the aerosolation mechanism.

The aerosolation mechanism 4*b* includes a supply port 1502 for supplying particle clusters 31, a collision plate 1504*a* provided in front thereof to serve as a mechanical barrier, and an ejection port 1505. A gas supply port 1507 is provided generally parallel to the collision plate 1504*a*, and the ejection port 1505 is provided in front of the gas supply port 1507.

The particle cluster 31 is supplied on the gas flow, collides with the collision plate 1504*a*, and is thereby disaggregated into primary particles 30P, or aggregate grains 30Q with several primary particles 30P aggregated therein. By squirting a gas from the gas supply port 1507 to the collision location, any powder compact adhered to the collision plate 1505*a* can be blown off, and a uniform aerosol can be generated.

Figure 22:
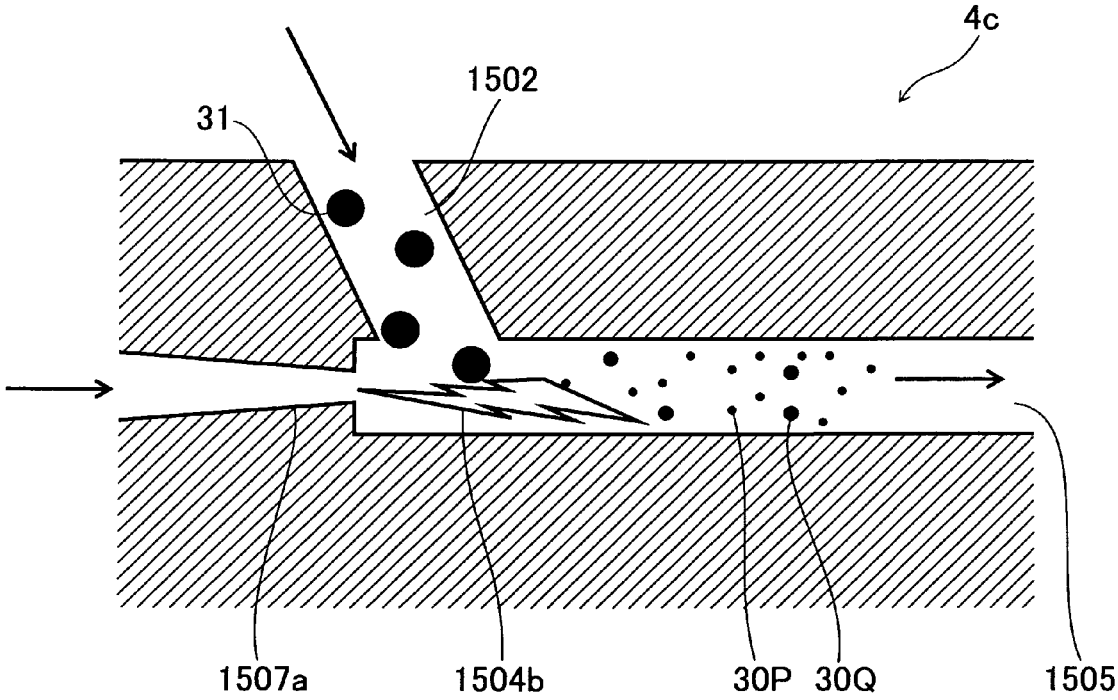
FIG. 22 is a schematic view for illustrating a third specific example of the aerosolation mechanism.

FIG. 22 is a schematic view for illustrating a third specific example of the aerosolation mechanism.

The aerosolation mechanism 4*c* includes a supply port 1502 for supplying particle clusters 31, a gas supply port 1507*a* for forming a pressure barrier in front thereof, and an ejection port 1505. The gas supply port 1507*a* is provided generally coaxial with the conduit provided with the ejection port 1505.

The particle cluster 31 is supplied on the gas flow and collides with the pressure barrier formed by the gas supply port 1507*a*. At this time, the particle cluster 31 is subjected to a shear force, and hence disaggregated into primary particles 30P, or aggregate grains 30Q with several primary particles 30P aggregated therein. Then, by the gas squirted from the gas supply port 1507, a uniform aerosol is formed.

Figure 23:
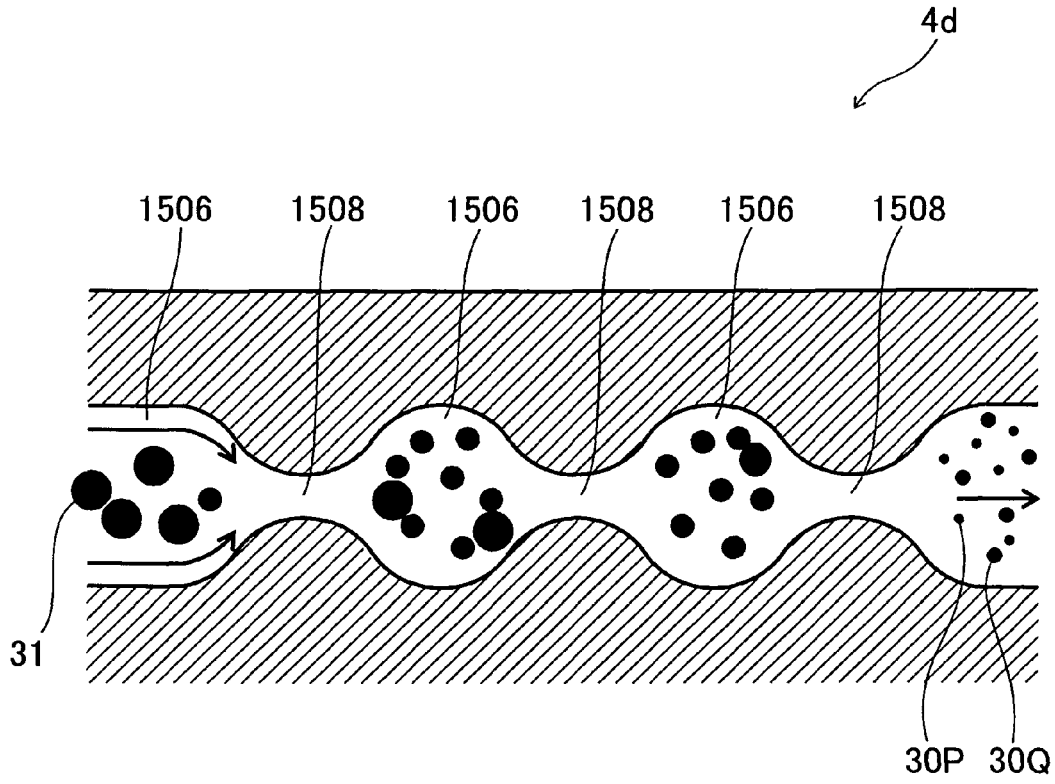
FIG. 23 is a schematic view for illustrating a fourth specific example of the aerosolation mechanism.

FIG. 23 is a schematic view for illustrating a fourth specific example of the aerosolation mechanism.

The aerosolation mechanism 4*d* includes a site 1506 having a large flow channel diameter and a site 1508 having a small flow channel diameter, which are alternately provided along the flow channel of the aerosol. Thus, the gas is compressed at the site 1508 having a small flow channel diameter, and expanded at the site 1506 having a large flow channel diameter. Repetition of such compression and expansion causes a shear force to act on the particle clusters 31 contained in the aerosol. This shear force disaggregates the particle cluster 31 into primary particles 30P, or aggregate grains 30Q with several primary particles 30P aggregated therein.

The number of sites 1506 having a large flow channel diameter and the number of sites 1508 having a small flow channel diameter are not limited to those illustrated, but can be suitably modified in accordance with the size and the like of the particle cluster 31 supplied.

Figure 24:
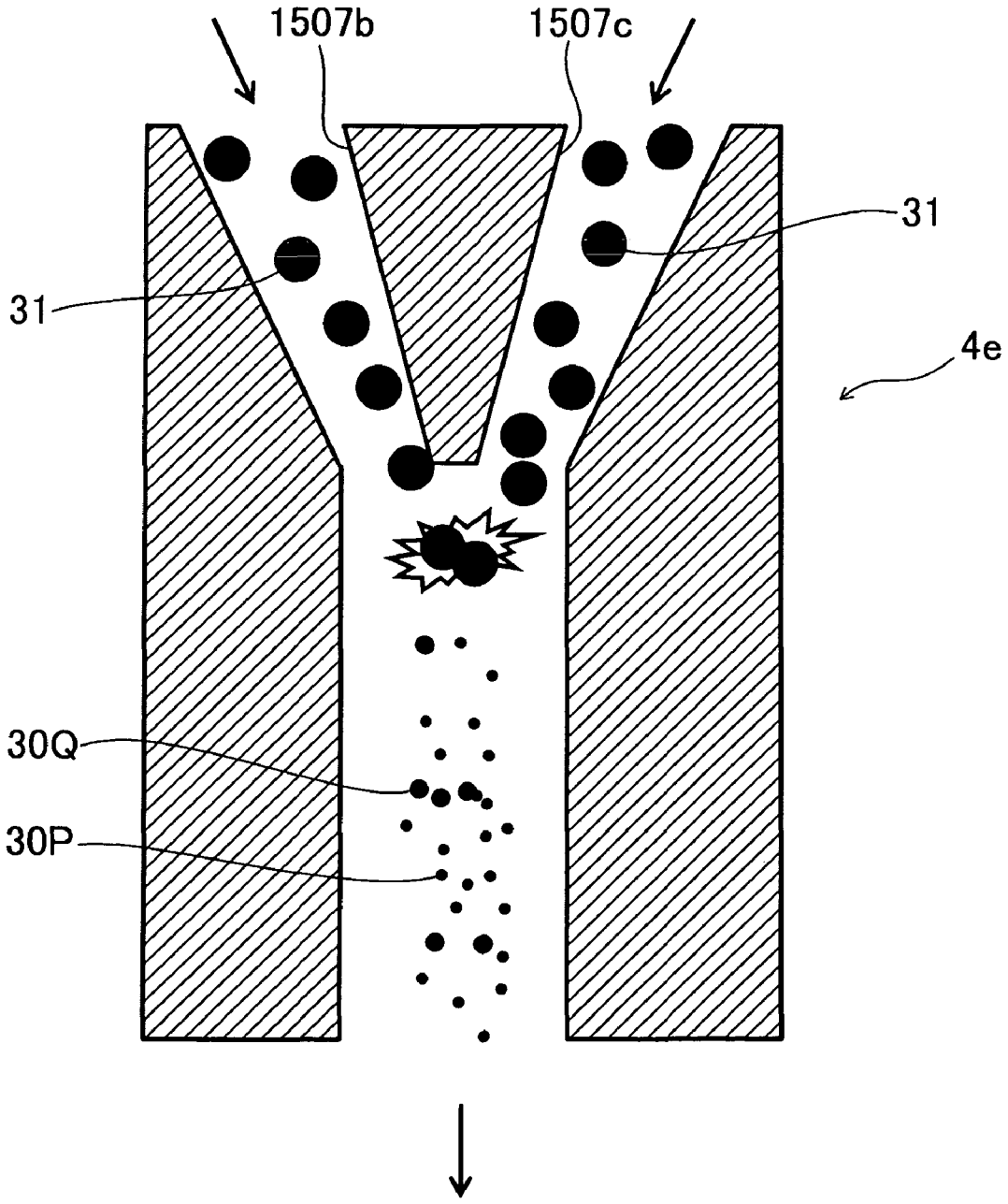
FIG. 24 is a schematic view for illustrating a fifth specific example of the aerosolation mechanism.

FIG. 24 is a schematic view for illustrating a fifth specific example of the aerosolation mechanism.

The aerosolation mechanism 4*e* includes a first gas supply port 1507*b* and a second gas supply port 1507*c*. The first gas supply port 1507*b* and the second gas supply port 1507*c* are provided so that their axis lines intersect each other.

Hence, particle clusters 31 supplied from the first gas supply port 1507*b* and the second gas supply port 1507*c* can be collided with each other. This collision disaggregates the particle clusters 31 into primary particles 30P, or aggregate grains 30Q with several primary particles 30P aggregated therein. In addition, this embodiment can avoid collision of particle clusters 31 with the wall surface, and has an advantage of being less prone to contamination.

Next, an experiment performed by the inventors in the course of reaching the invention is described.

Figure 25:
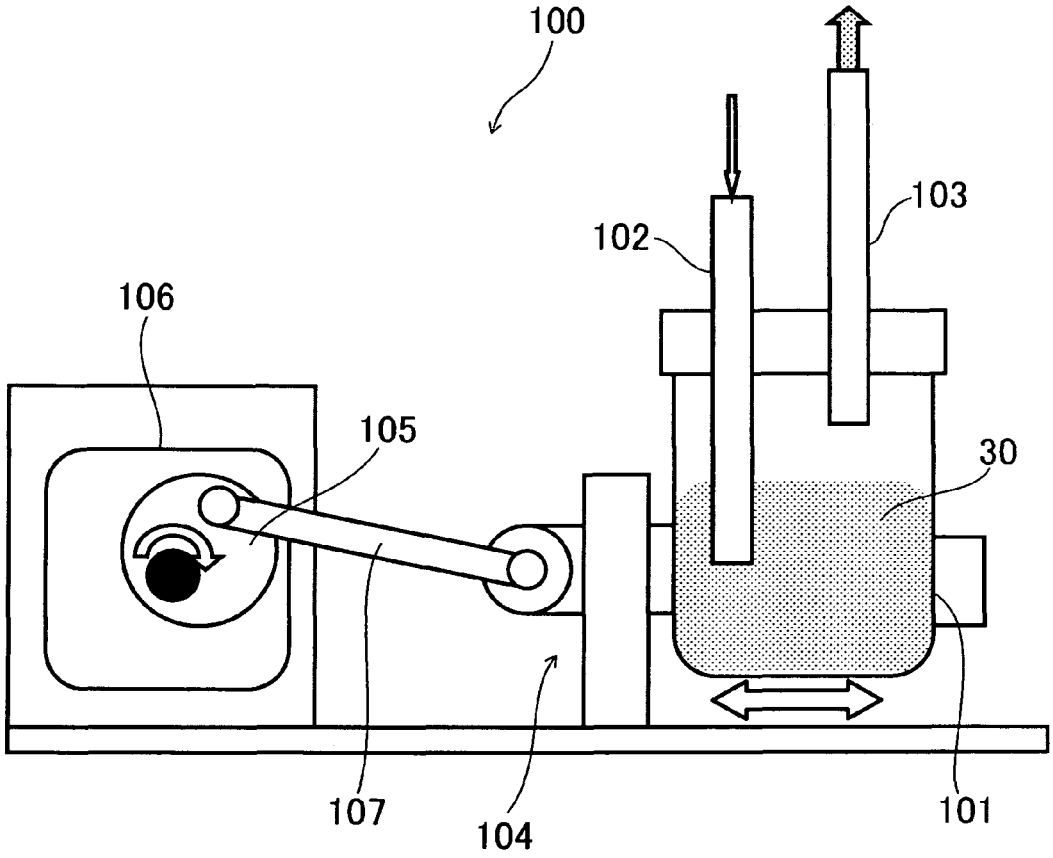
FIG. 25 is a schematic view for describing an aerosol generator used in a comparative experiment.

FIG. 25 is a schematic view for describing an aerosol generator used in a comparative experiment.

As shown in FIG. 25, the aerosol generator 100 includes a container 101 for storing fine particles 30, a gas introduction port 102 for introducing a gas into the container 101, an aerosol extraction port 103 for extracting an aerosol from the container 101, a vibration generating means 104 for applying horizontal vibration to the container 101, a crank 105 provided on the output shaft of a motor 106 to convert rotary motion to linear reciprocation, and a link 107 coupling the crank 105 to the vibration generating means 104.

A gas introduced from a gas supply means, not shown, through the gas introduction port 102 into the container 101 blows up fine particles 30 to form an aerosol, which is extracted outside from the aerosol extraction port 103. The rotary motion caused by the motor 106 is converted to linear reciprocation by the crank 105 and transmitted through the link 107 to the vibration generating means 104. Hence, the vibration generating means 104 undergoes horizontal linear reciprocation, which stirs fine particles 30 inside the container 101.

First, the variation of the fine particle concentration (beam concentration) in the aerosol was measured in the case of using the aerosol generator 100 shown in FIG. 25 and the case of using the supply mechanism 2 according to the embodiment of the invention illustrated in FIG. 13. Here, the fine particle used was made of high-purity barium titanate having a mean particle diameter of 0.3 micrometers. The gas was helium gas with a supply quantity of 14.4 L/min.

The fine particle concentration was the beam concentration (concentration in the aerosol discharged from the discharge port). The aerosol discharged from the discharge port was irradiated with laser light, and the intensity of scattered light was sensed and digitized by a CCD sensor.

Figure 26A:
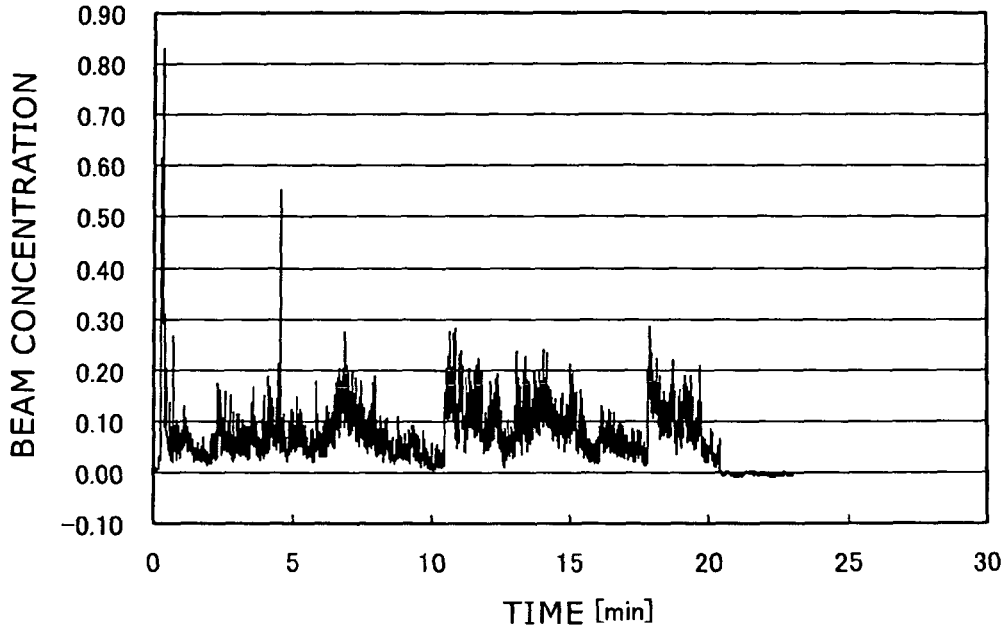
FIGS. 26A and 26B are graphs for illustrating the variation of beam concentration.
Figure 26B:
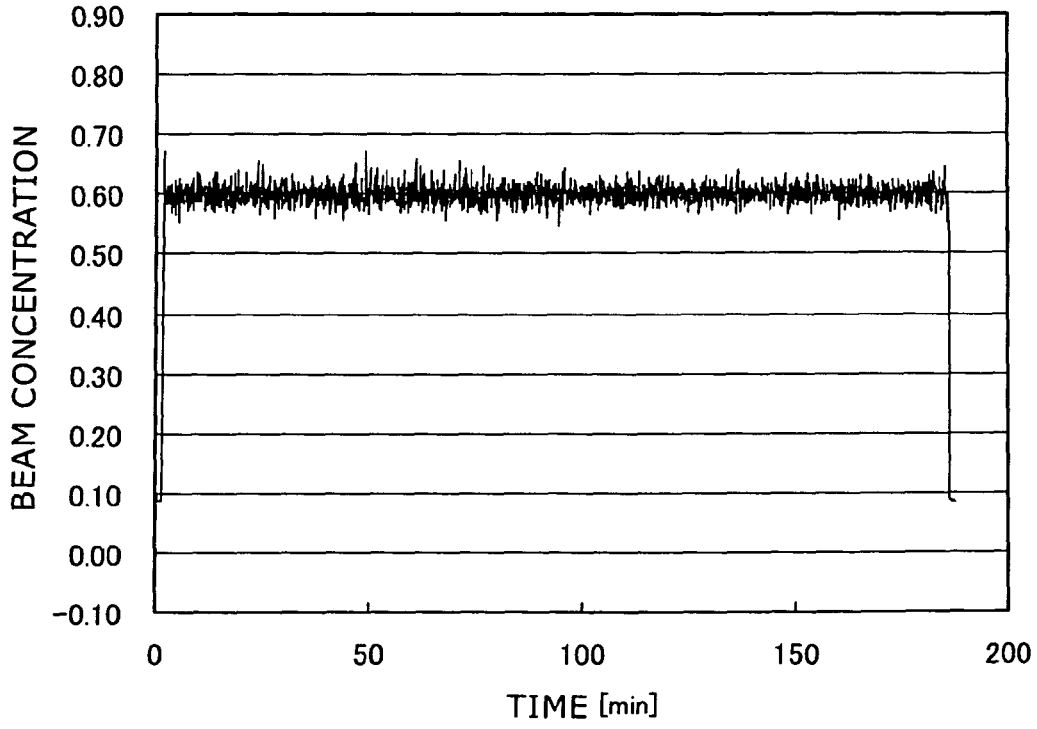

FIG. 26 is a graph for illustrating the variation of beam concentration, where FIG. 26A shows the case of using the aerosol generator 100 shown in FIG. 25, and FIG. 26B shows the case of using the supply mechanism 2 according to the embodiment of the invention illustrated in FIG. 13.

As seen from FIG. 26A, in the case of using the aerosol generator 100 shown in FIG. 25, the beam concentration was not stabilized, and the aerosol supply quantity was also unable to be kept large. This is because barium titanate fine particles were aggregated in the aerosol generation container 100 and changed to the state where an aerosol is difficult to generate.

On the other hand, as seen from FIG. 26B, in the case of using the supply mechanism 2 according to the embodiment of the invention, a high beam concentration can be stably maintained for a long period of time. This is because particle clusters are continuously and stably supplied to the aerosol generation mechanism, and also because the state of particles supplied is constantly stable.

Figure 27:
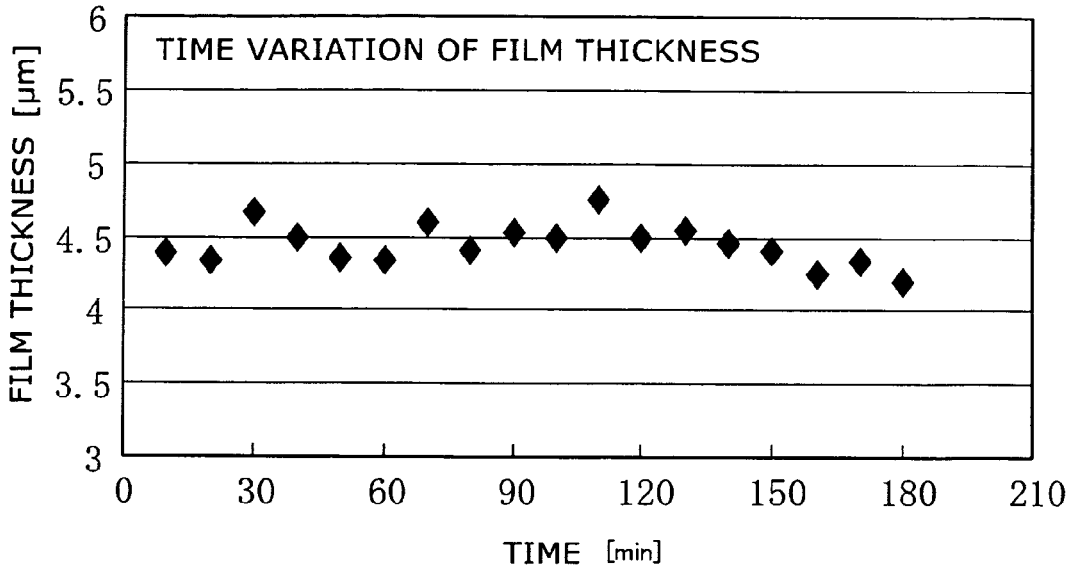
FIG. 27 is a graph for illustrating the time variation of film thickness in the case of using the supply mechanism according to the embodiment of the invention.

FIG. 27 is a graph for illustrating the time variation of film thickness in the case of using the supply mechanism 2 according to the embodiment of the invention.

Film formation was performed on a rectangular sample with X direction×Y direction=250 millimeters×200 millimeters. The relative position of the discharge port was scanned reciprocatively in the X direction and unidirectionally in the Y direction to form a film-like structure. The film thickness was measured at the center in the X direction. Measurement of film thickness was performed using a profilometer to measure the step height caused by a masking layer provided at the center with the measurement position shifted in the Y direction. Thus, the temporal variation of film formation can be determined. Here, the fine particle used was made of high-purity barium titanate having a mean particle diameter of 0.3 micrometers.

As seen from FIG. 27, by using the supply mechanism 2 according to the embodiment of the invention, the accuracy of film thickness can be set to approximately $\pm^{7}$%. Thus, the film thickness can be made uniform also over time.

Figure 28:
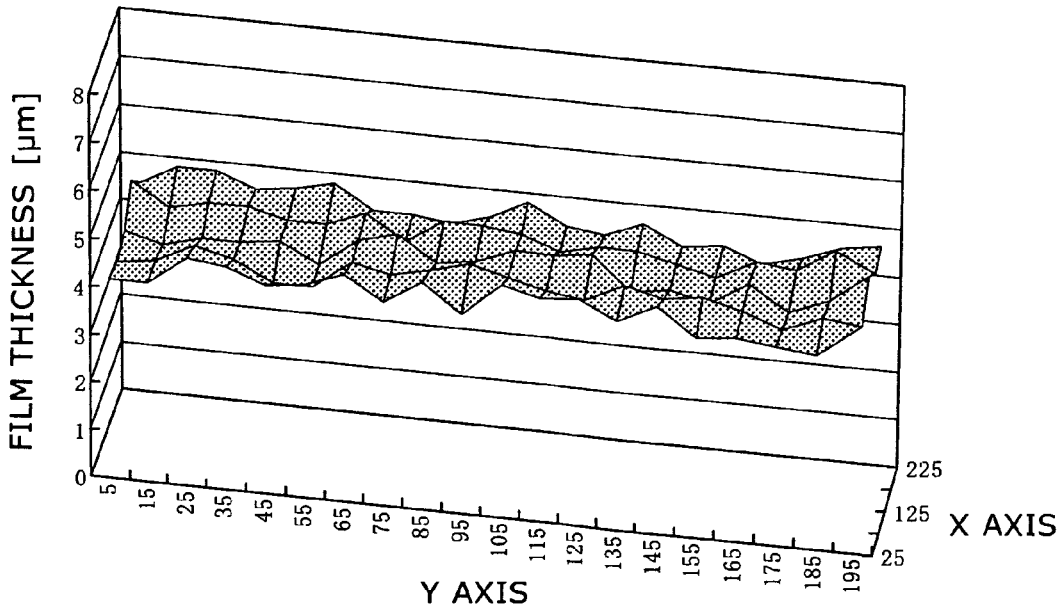
FIG. 28 is a graph for illustrating film formation capability in the case of using the particle cluster according to the embodiment of the invention.

FIG. 28 is a graph for illustrating film formation capability in the case of using the particle cluster according to the embodiment of the invention.

Film formation was performed on a rectangular sample with X direction×Y direction=250 millimeters×200 millimeters. The relative position of the discharge port was scanned reciprocatively in the X direction and unidirectionally in the Y direction to form a film-like structure. The reciprocating scan in the X direction was performed at a scan rate of 10 mm/sec, with each step in the Y direction being 0.5 mm. The gross film formation time in this case was approximately 190 minutes. To measure the thickness of the film obtained, a profilometer was used to measure the step height caused by a masking layer provided at various positions on the sample.

Here, the particle cluster was made of high-purity barium titanate having a mean particle diameter of 0.3 micrometers, and having a shape such that the spatula angle is 46.2° or less.

As for the film formation condition, the supply quantity of helium gas was 14 L/min in terms of the value at the atmospheric pressure, and the supply quantity of particle clusters was 2.0 g/min. The quantity of particle clusters used in this case was approximately 400 g.

As seen from FIG. 28, the mean film thickness can be set to 4.5 micrometers, with a standard deviation of 0.25 and a film thickness accuracy of approximately ±5%. Thus, it was confirmed that the film thickness can be made uniform also over time.

This is because particle clusters are continuously and stably supplied to the aerosolation mechanism 4, suggesting that the state of particle clusters supplied and transported is also constantly stable.

Next, a transport experiment in the case of using fine particles or particle clusters is described.

The fine particle used was made of high-purity barium titanate having a mean particle diameter of 0.3 micrometers. The particle cluster according to the embodiment of the invention was also formed from high-purity barium titanate having a mean particle diameter of 0.3 micrometers. Here, the particle cluster has a shape such that the spatula angle is 46.2° or less.

In the transport experiment, the vibrating feeder as illustrated in FIG. 15 was used. Using particle clusters formed in advance (particle clusters according to the embodiment of the invention) and untreated fine particles, the transport weight in each case was measured with the transport settings of the vibrating feeder left unchanged.

Figure 29A:
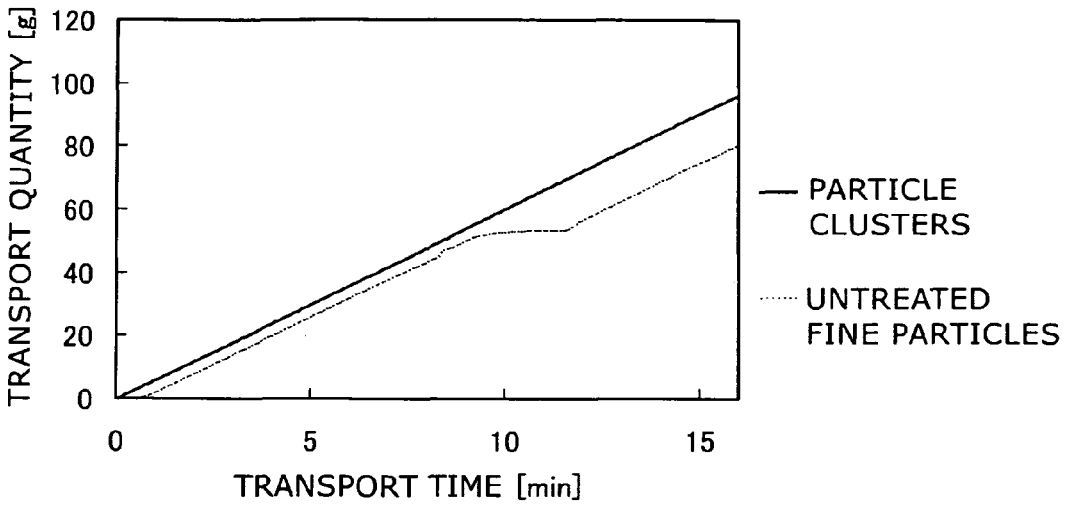
FIGS. 29A and 29B are graphs for illustrating the result of the transport experiment.
Figure 29B:
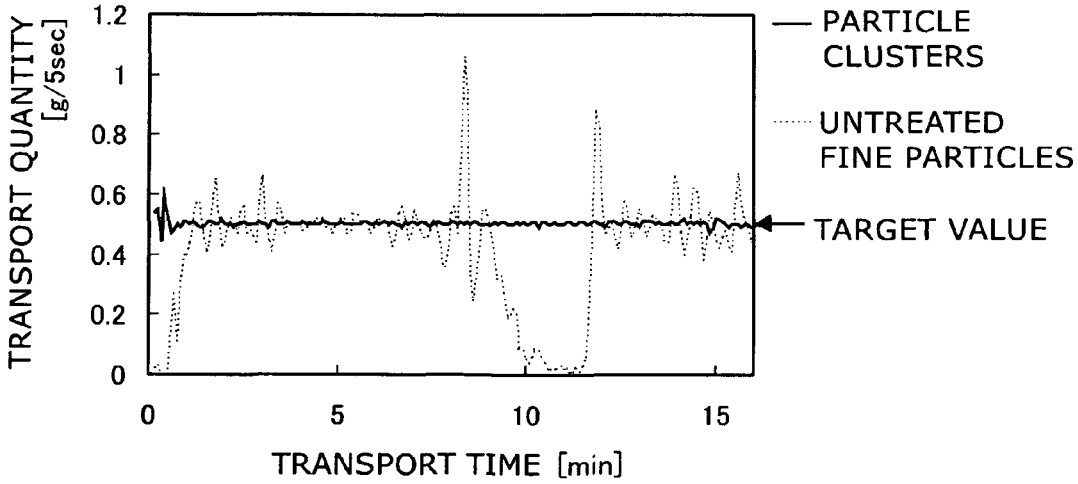

FIG. 29 is a graph for illustrating the result of the transport experiment, where FIG. 29A shows cumulative transport quantity, and FIG. 29B shows transport quantity per 5 sec (seconds) (transport rate).

As seen from FIG. 29, for untreated fine particles (with no particle clusters formed), accurate transport was unsuccessful as compared with the planed transport quantity. A phenomenon of supply stoppage (around 10 min in FIG. 29) due to stacking of fine particles in the storage mechanism was observed.

On the other hand, for particle clusters according to the embodiment of the invention, a stable transport performance as compared with the planed value was successfully maintained, and no trouble such as stacking in the storage mechanism was observed.

Next, suitability of fine particles and particle clusters to the configuration of the supply mechanism 2 is described.

Particle clusters according to the embodiment of the invention and untreated fine particles were supplied using the supply mechanism 2 having the same apparatus configuration, and the suitability thereof was studied.

TABLE 2 illustrates the result of studying the suitability.

TABLE 2

| State of fine particles | Supply mechanism | Stacking-prone | Quantitative supply |
|---|---|---|---|
| Untreated (raw powder) | Vibrating (FIG. 15) | x | x |
| | Mesh (FIG. 13) | x | Δ |
| | Screw (FIG. 17) | x | x |
| Particle cluster | Vibrating (FIG. 15) | ○ | ○ |
| | Mesh (FIG. 13) | ○ | ○ |
| | Screw (FIG. 17) | ○ | Δ |

In TABLE 2, "o" indicates that the result is good, and "Δ" indicates that the result is acceptable. On the other hand, "x" indicates that the result is unacceptable.

As seen from TABLE 2, if untreated fine particles are supplied, there are problems with stacking-proneness (likelihood of stacking) and quantitativeness in supply, whichever apparatus configuration is used for the supply mechanism 2.

On the other hand, if particle clusters according to the embodiment of the invention are supplied, the supply is superior in stacking-proneness and quantitativeness in supply. Consequently, the fine particle concentration in the aerosol can be kept constant, and the film thickness and film quality can be made uniform even in film formation over a large area.

Next, the relationship between gas flow rate and film formation performance is described in the case where particle clusters are transported on a solid-gas mixed phase flow and an aerosol is generated by a collision-based disaggregation means.

Particle clusters according to the embodiment of the invention were used to evaluate film formation performance while varying the flow rate of the gas used during film formation.

The particle cluster used was made of aluminum oxide. The gas was nitrogen gas or helium gas, with a flow rate of 0.01 to 10 L/(min·mm$^2$) for the minimum cross-sectional area of the channel traversed by the aerosol in terms of the value at the atmospheric pressure and 25° C.

The relative position of the discharge port was moved 30 mm, and this movement was reciprocated 30 times. The thickness of the film resulting therefrom was measured.

Figure 30:
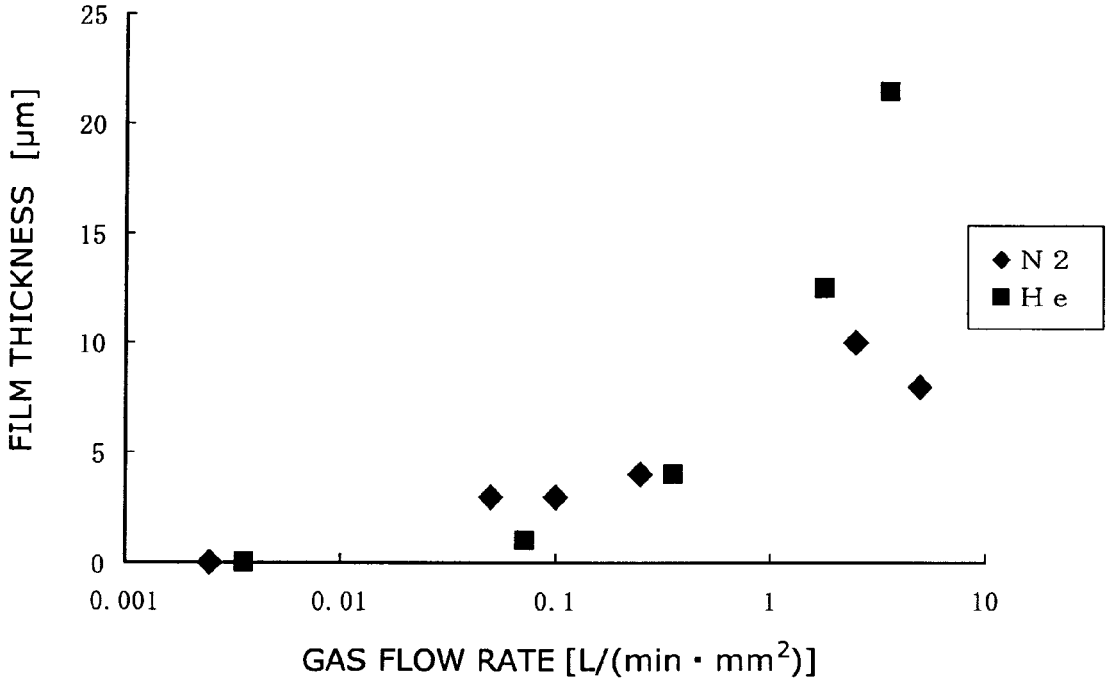
FIG. 30 is a graph for illustrating the relationship between gas flow rate and film formation performance.

FIG. 30 is a graph for illustrating the relationship between gas flow rate and film formation performance.

As seen from FIG. 30, when the flow rate of nitrogen gas or helium gas was 0.01 L/(min·mm$^2$) or less, particle clusters discharged directly were observed. At most, adherents like powder compacts were adhered onto the substrate, and no structure obtained by the so-called aerosol deposition method was formed. This suggests the impossibility of structure formation by aerosol deposition in the state of particle clusters, and the insufficiency of mechanical impact force for disaggregation and aerosolation of particle clusters before discharge.

On the other hand, it was confirmed that if the gas flow rate is increased, the film thickness can be increased to obtain a good structure. For nitrogen gas, it was confirmed that a structure due to aerosol deposition was obtained at a gas flow rate of 0.05 L/(min·mm$^2$) or more. Furthermore, at a gas flow rate of approximately 6 L/(min·mm$^2$), the film thickness of the structure formed by aerosol deposition was maximized. Under the condition allowing a structure due to aerosol deposition to be formed, it was confirmed that an aerosol disaggregated from particle clusters was discharged from the discharge port.

The embodiment of the invention has been described. However, the invention is not limited to the foregoing description.

The above embodiment and specific examples can be suitably modified by those skilled in the art, and such modifications are also encompassed within the scope of the invention as long as they fall within the spirit of the invention.

For instance, any composite structure formation system (aerosol deposition apparatus) and composite structure formation method suitably modified by those skilled in the art are also encompassed within the scope of the invention as long as they fall within the spirit of the invention.

The fine particle is also not limited to those illustrated, but may be a brittle material such as oxides like aluminum oxide, yttrium oxide, zirconium oxide, titanium oxide, silicon oxide, barium titanate, lead zirconate titanate, as well as nitrides, borides, carbides, and fluorides, or a composite material composed primarily of a brittle material in combination with a metal or resin.

The gas is also not limited to those illustrated, but may be air, hydrogen gas, nitrogen gas, oxygen gas, argon gas, helium gas, or other inert gas, or an organic gas such as methane gas, ethane gas, ethylene gas, and acetylene gas, or a corrosive gas such as fluorine gas. Furthermore, a mixed gas thereof may be used as needed.

The elements included in the above embodiment and specific examples can be combined with each other as long as feasible, and such combinations are also encompassed within the scope of the invention as long as they fall within the spirit of the invention.

The invention claimed is:

1. A composite structure formation method comprising:

transporting particle clusters formed in a prescribed shape in advance and stored in a storage mechanism from the storage mechanism to an aerosolation mechanism in combination with a gas supplied from a gas supply mechanism;

disaggregating the transported particle clusters to form an aerosol; and spraying the aerosol toward a substrate to form a composite structure having the substrate and a structure made of a constituent material of the particle clusters, wherein each of the particle clusters is an assemblage of fine particles which has been intentionally packed by non-chemical coupling, the fine particles including particles having a mean particle diameter of 0.1 micrometers or more and 10 micrometers or less, the particle clusters are controlled to have a spatula angle of 46.2 degree or less, and controlled to have a mean particle diameter of 10 micrometers or more and 500 micrometers or less, said transporting involves controlling a force imparted to the particles clusters when transporting from the storage mechanism to be sufficiently small so that the shape of the particle clusters is not impaired, and whereby a uniform quantitativeness in supply of the particle clusters is achieved when transporting from the storage mechanism.

2. The composite structure formation method according to claim 1, wherein said transporting to the aerosolation mechanism is performed by a solid-gas mixed phase flow formed from the particle clusters transported from the storage mechanism and the gas supplied from the gas supply mechanism, and wherein the solid-gas mixed phase flow is formed by mixing the particle clusters and the gas after said quantitativeness in supply is achieved when transporting from the storage mechanism.

3. The composite structure formation method according to claim 1, wherein the gas has a volume flow rate of 0.05 L/(min·mm$^2$) or more and 50.0 L/(min·mm$^2$) or less in terms of the value at 1 atmosphere and 25° C. for the minimum cross-sectional area of a transport channel to the aerosolation mechanism.

4. A composite structure formation method comprising:

transporting particle clusters formed in a prescribed shape in advance and stored in a storage mechanism from the storage mechanism to an aerosolation mechanism;

disaggregating the transported particle clusters in combination with a gas supplied from a gas supply mechanism to form an aerosol; and spraying the aerosol toward a substrate to form a composite structure of the substrate and a structure made of a constituent material of the particle clusters, wherein each of the particle clusters is an assemblage of fine particles which has been intentionally packed by non-chemical coupling, the fine particles including particles having a mean particle diameter of 0.1 micrometers or more and 10 micrometers or less, the particle clusters are controlled to have a spatula angle of 46.2 degree or less, and controlled to have a mean particle diameter of 10 micrometers or more and 500 micrometers or less, a shape of the particle clusters is maintained during said transporting from the storage mechanism, and whereby a uniform quantitativeness in supply of the particle clusters is achieved when transporting from the storage mechanism.

5. The composite structure formation method according to claim 4, wherein the gas has a volume flow rate of 0.05 L/(min·mm$^2$) or more and 50.0 L/(min·mm$^2$) or less in terms of the value at 1 atmosphere and 25° C. for the minimum cross-sectional area of a transport channel to the aerosolation mechanism.

* * * * *